US005569011A

United States Patent [19]

Yamaguchi et al.

[11] Patent Number: 5,569,011

[45] Date of Patent: Oct. 29, 1996

[54] BOOK BINDING APPARATUS

[75] Inventors: Yoshimasu Yamaguchi, Kawasaki; Yuji Takahashi, Tokyo; Kimiaki Hayakawa; Toshihiko Kusumoto, both of Yokohama; Hideaki Kosasa; Hiroshi Ohta, both of Tokyo; Yuji Yamanaka, Kawasaki; Kozo Sakakibara, Yokohama, all of Japan

[73] Assignee: Canon Kabushiki Kaisha, Tokyo, Japan

[21] Appl. No.: 281,661

[22] Filed: Jul. 28, 1994

[30] Foreign Application Priority Data

Jul. 30, 1993 [JP] Japan ..... 5-208813

[51] Int. Cl.[6] ..... B42B 5/04

[52] U.S. Cl. ..... 412/9; 412/33; 412/36

[58] Field of Search ..... 412/1, 8, 9, 19, 412/25, 33, 36, 37, 900, 902

[56] References Cited

U.S. PATENT DOCUMENTS

| | | | |
|---|---|---|---|
| 2,532,535 | 12/1950 | Biesen | 412/36 |
| 2,897,522 | 8/1959 | Fotiades | 412/36 |
| 3,223,436 | 12/1965 | Becker | 412/36 |
| 4,531,873 | 7/1985 | Voges | 412/36 |
| 4,828,645 | 5/1989 | Van Bortel | 56/384 |
| 5,346,350 | 9/1994 | Luhman et al. | 412/37 |

FOREIGN PATENT DOCUMENTS

| | | |
|---|---|---|
| 427279 | 5/1991 | European Pat. Off. . |

*Primary Examiner*—Willmon Fridie, Jr.

*Attorney, Agent, or Firm*—Fitzpatrick, Cella, Harper & Scinto

[57] ABSTRACT

A book binding apparatus comprises a convey means for conveying a sheet on which an image was formed by an image forming means, a plurality of sheet supporting means for supporting a sheet bundle to align ends of the sheets, a switching means for selecting one of the sheet supporting means to send the sheet conveyed by the convey means to the selected sheet supporting means, a bind means for adhering a bind tape to an end of the sheet bundle, and a move means for moving the aligned end of the sheet bundle supported by the sheet supporting means to the bind means.

34 Claims, 27 Drawing Sheets

BOOK BINDING APPARATUS

BACKGROUND OF THE INVENTION

1. Field of the Invention

The present invention relates to a book binding apparatus in which imaged sheets are glue-bound as a book, and more particularly, it relates to a book binding apparatus which is applicable to an on-line system wherein a plurality of image forming apparatuses required for forming images on sheets successively, a book binding apparatus for bookbinding the sheets on which the images were formed and a sorting and containing apparatus for sorting and containing the bookbound sheet bundles are interconnected.

2. Related Background Art

In the past, when a plurality of sheets on which images were formed are automatically glue-bound to obtain a book, an on-line system wherein a plurality of apparatuses required for performing such jobs are interconnected has been used. For example, the on-line system includes a reading and sheet supplying apparatus comprising an original setting portion for setting an original, an optical system for scanning the original, and a sheet supplying apparatus for containing a number of sheets and for supplying the sheet; an image forming apparatus for forming an image on the sheet supplied from the sheet supplying apparatus; a book binding apparatus for bookbinding the sheets on which the images were formed; and a sheet sorting and containing apparatus for sorting and containing the bookbound or finished sheet bundles or the sheets. These apparatuses are interconnected in series.

When the sheet bundle is bookbound in the book binding apparatus, the sheet bundle aligned in a sheet align tray is glue-bound by a gluing binder. A bind tape used with the gluing binder is of hot melt type. The bind tape is abutted against the sheet bundle and is adhered to the sheet bundle by melting glue by means of a heater. Further, the sheets were contained in a single sheet align tray and were aligned with each other by abutting the sheets against an abutment member. The sheet bundle and the bind tape abutted against the sheet bundle were heated by a single tape heating apparatus. Further, a single stacker was provided in an apparatus for containing the finished sheet bundles.

However, in the conventional book binding apparatuses, it took a long time for melting the glue on the bind tape after the bind tape is set in the tape heating apparatus. Further, even when the molten bind tape abutted against the sheet bundle was heated, since the heat was absorbed by the sheet bundle, the bind tape could not adhered to the sheet bundle sufficiently. That is to say, it took a long time for heating the sheet bundle having the room temperature up to the gluing temperature. Further, the image forming apparatus of high speed type wherein a distance between supplied sheets is relatively short is used with the on-line system. Accordingly, when the single sheet align tray is used, since the sheets are successively supplied while the sheets in the tray are being aligned, the productivity of the system is worsened. In addition, as mentioned above, since it takes a long time for heating the sheet bundle, the productivity is further reduced.

Further, when the sheets entered into the sheet align tray are aligned with each other, if any sheet abutted against the abutment member is bounded away from the abutment member and the next sheet is rested on the bounded sheet, tip ends of the sheets cannot be aligned with each other, thereby causing the poor bookbinding. Further, when each sheet is double-folded or Z-folded, a trailing end of the sheet bundle rested on the sheet align tray is swelled, with the result that the next sheet is struck against the sheet bundle, thereby causing the poor sheet conveyance. Further, when the single stacker for containing the finished sheet bundles is used, in the case where a plurality of sheet bundles are bookbound, the finished condition of any sheet bundle cannot be ascertained until the bookbinding of all of the sheet bundles is completed, thus causing the inconvenience. That is to say, when an operator tries to draw the stacker to check the sample of the finished sheet bundle, the system must be stopped temporarily, thereby reducing the productivity.

SUMMARY OF THE INVENTION

An object of the present invention is to provide a book binding apparatus which can achieve high productivity corresponding to an image forming speed of an image forming apparatus.

To achieve the above object, according to the present invention, there is provided a book binding apparatus comprising a convey means for conveying a sheet on which an image was formed by an image forming means, a plurality of sheet supporting means for supporting a sheet bundle to align ends of the sheets, a switching means for selecting one of the sheet supporting means to send the sheet conveyed by the convey means to said sheet supporting means, a bind means for adhering a bind tape to an end of the sheet bundle, and a transfer means for transferring the aligned end of the sheet bundle supported by the sheet supporting means to the bind means.

With this arrangement, when an image forming speed of the image forming means is greater than a bookbinding speed, the sheets on which the images were formed are successively sent to the plurality of sheet supporting means to be supported thereby, so that the bookbinding operations can be effected successively, thus improving the bookbinding efficiency.

Further, the present invention provides a book binding apparatus wherein the bind means has a plurality of heat means for heating heat-soluble adhesive for adhering the bind tape to the end of the sheet bundle, and further comprising a shift means for shifting the heat means between a bind position and a waiting position alternatively, and a bind tape supply means for supplying the bind tape to the heat means at the waiting position.

With this arrangement, since the bind tape can be previously heated to melt the heat-soluble adhesive, the binding operation can be effected quickly, thereby reducing the bookbinding time.

Further, the present invention provides a book binding apparatus wherein the sheet supporting means includes a pre-heat means for previously heating the aligned end of the sheet bundle before the binding operation.

With this arrangement, the aligned end of the sheet bundle can be previously heated before it is bound, thereby effecting the binding operation quickly without decreasing the temperature of the heat means during the binding operation, thereby reducing the bookbinding time.

DETAILED DESCRIPTION OF THE PREFERRED EMBODIMENTS

Now, a first embodiment of the present invention will be explained with reference to the accompanying drawings.

Figure 1:
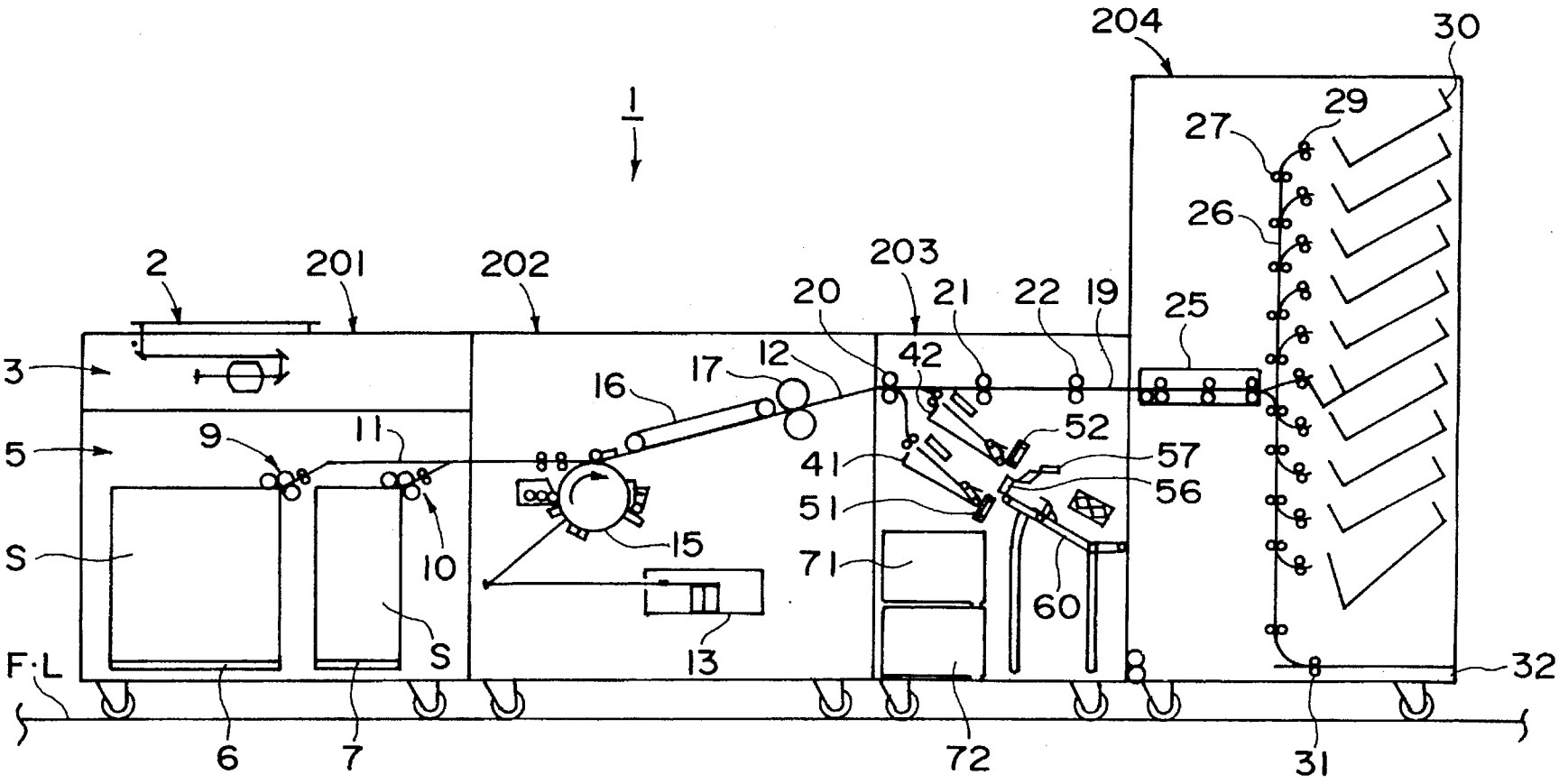
FIG. 1 is a side elevational sectional view of an on-line system to which an embodiment of the present invention is applied.

In FIG. 1, an on-line system 1 comprises an original reading and sheet supplying apparatus 201, an image forming apparatus 202, a bookbinding apparatus 203, and a sheet sorting and containing apparatus 204, which apparatuses are interconnected in series.

The reading and sheet supplying apparatus 201 includes, at an upper portion thereof, an original setting portion 2 on which an original (not shown) is rested, and an optical system 3 which can read and scan the original. In a lower portion of the apparatus 201, there are arranged a plurality of decks 6, 7 on which sheets S having different sizes are stacked, respectively, and sheet supply portions 9, 10 for supplying the sheets.

The supplied sheet S is conveyed to a sheet convey path 12 of the image forming apparatus 202 through a sheet convey path 11. Incidentally, the reference numeral 13 denotes a laser scanner for emitting laser light in response to image information read by the optical system 3; and 15 denotes an image forming portion which is scanned by the laser scanner 13 and on which a toner image is formed. The sheet S on which an image was formed at the image forming portion 15 is conveyed to a sheet convey path 19 of the bookbinding apparatus 203 via a convey belt 16 and a pair of convey rollers 17.

The bookbinding apparatus 203 includes first and second sheet align trays 41, 42 for containing and aligning the sheets S branched and conveyed from the sheet convey path 19, first and second abutment members 51, 52 against which a tip end of the sheet is abutted, first and second tape heating apparatuses 56, 57 for heating the aligned sheet bundle and a bind tape, a handling member 63 for handling the bookbound sheet bundle, a carriage 60 which can be shifted in an up-and-down direction and on which the handling member 63 is mounted, and stackers 71, 72 for storing the bookbound sheet bundles.

The sheet sorting and containing apparatus 204 includes an elevator 25 for sending the sheet S conveyed from a sheet convey path 19 to a convey path 26, pairs of convey rollers 27 disposed at a plurality of branched portions of the convey path 26, and pairs of discharge rollers 29 for discharging the sheets S branched at the branched portions onto corresponding discharge trays 30. Further, the bookbound sheet bundle discharged from the bookbinding apparatus 203 is discharged from a discharge opening 32 of the system through the elevator 25 and a pair of convey rollers 31.

Next, the bookbinding apparatus 203 will be fully explained with reference to FIG. 2.

Figure 2:
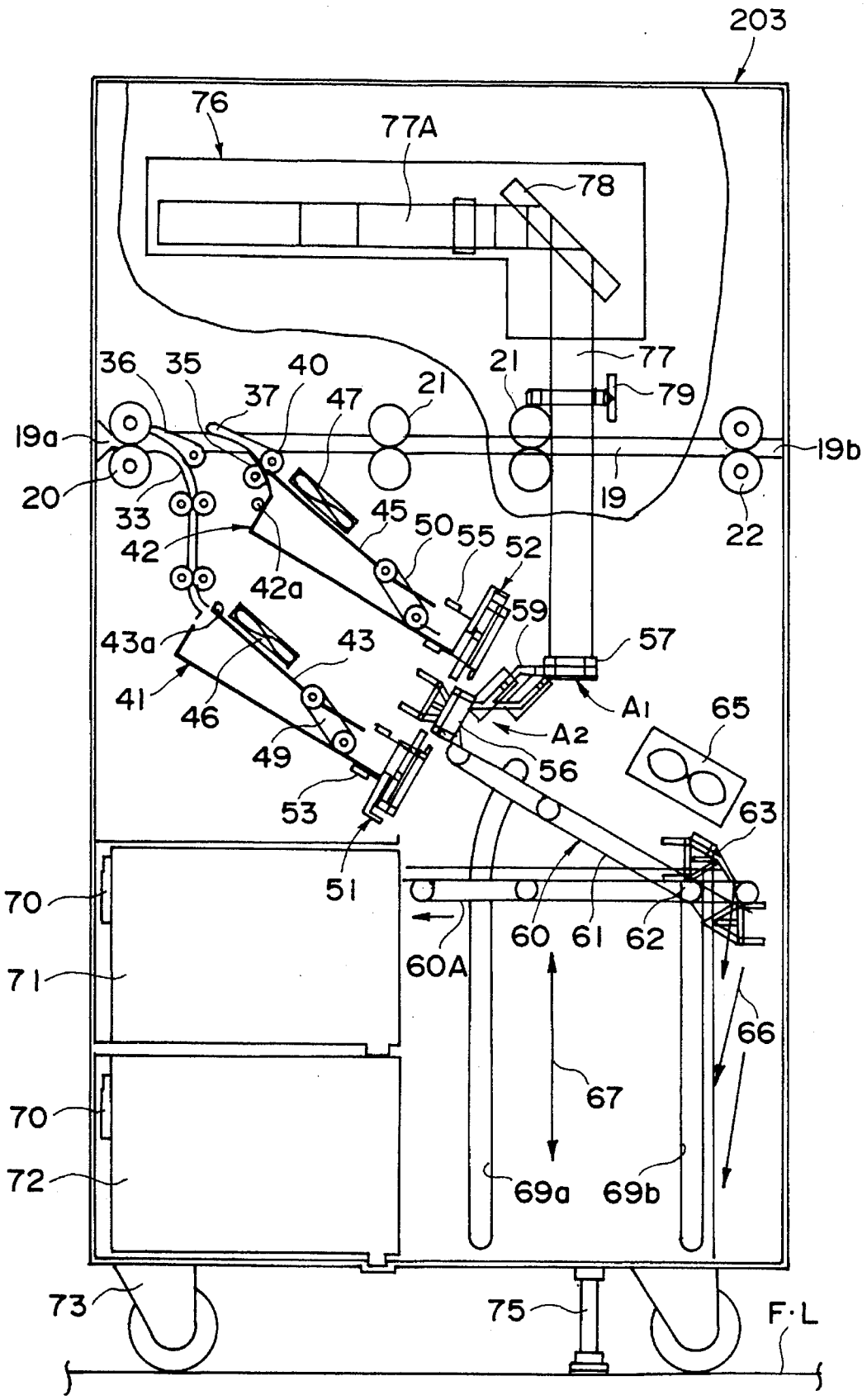
FIG. 2 is an elevational sectional view of a book binding apparatus of FIG. 1.

In FIG. 2, the book binding apparatus 203 includes a sheet convey path 19 (convey means) for conveying the sheet sent from the image forming apparatus 202, and the sheet convey path 19 has an inlet end 19*a* and a discharge end 19*b*. A pair of introduction rollers 20, a plurality of pair of convey rollers 21 and a pair of discharge rollers 22 are arranged along the sheet convey path 19 from an upstream side to a downstream side thereof. In the proximity of the downstream side of the pair of introduction rollers 20, there are arranged first and second flappers 36, 37 capable of guiding the sheet from the sheet convey path 19 to guide portions 33, 35, respectively. The flappers 36, 37 are selectively operated to direct the sheet S to either of the guide portions 33, 35. When both of the flappers 36, 37 are not operated, the sheet S is conveyed through the sheet convey path 19.

A first sheet align tray 41 having an upper guide plate 43 is disposed at a downstream side of the guide portion 33, and a first abutment member 51 against which the sheet S is abutted is formed on a tip end of the sheet align tray. The sheets S sent to the first align tray 41 by a pair of convey rollers 39 ape shifted toward the first abutment member 51 by a sweeping and collecting member 49 comprising a rotatable belt which can be rocked around its one end (upper left end in FIG. 2) so that the sheets ape abutted against an align surface of the first abutment member 51 to be aligned with each other. A fan 46 arranged above the upper guide plate 43 serves to urge the sheets S against the first sheet align tray 41 by air to prevent the folded sheets from swelling. Incidentally, the reference numeral 53 denotes a clamp member for clamping the sheet bundle having a predetermined number of sheets.

A second sheet align tray 42 disposed above the first sheet align tray 41 is constituted similar to the latter, and a pair of convey rollers 40, an upper guide plate 45, a second abutment member 52, a sweeping and collecting member 50, a fan 47 and a clamp member 55 are associated with the second sheet align tray.

Next, a bind means for binding the sheet bundle by using a bind tape will be explained.

A tape reel 77A is housed in a tape unit 76 arranged within the book binding apparatus 203 at an upper part thereof. A bind tape 77 unwound from the tape reel is directed in a vertical direction via an inclined deflection roller 78. The bind tape 77 is cut to a predetermined length by a cutter 79 and is sent to a tape supply position where a second tape heating apparatus 57 which will be described later is arranged. A first tape heating apparatus 56 serves to heat a back surface of the bind tape 177 at a back abutment position (bind position), thereby bonding the sheet bundle. A pass-by path 59 serves to guide the first and second tape heating apparatuses 56, 57 without collision therebetween.

A carriage 60 includes a convey belt (convey means) 61 and a handling member 63 movable together with the convey belt. The carriage can be rocked around a roller shaft of a roller 62 and be shifted in a vertical direction shown by the arrow 67 along a pair of vertical slots 69*a*, 69*b*. The handling member 63 serves to handle the sheet bundle bookbound by the first tape heating apparatus 56 and to shift the sheet bundle toward the roller 62 by rotation of the convey belt 61, thereby resting the sheet bundle on the carriage 60.

The reference numeral 66 denotes directions of air flow generated by a fan (not shown) for cooling the bookbound sheet bundle. The sheet bundle is sent from the carriage 60 into a stacker 71 or 72. The stackers 71, 72 are retractably supported by rails 70. Incidentally, the reference numeral 73 denotes casters for shiftably supporting the bookbinding apparatus; and 75 denotes a leveller for adjusting the height of the book binding apparatus.

Figure 3:
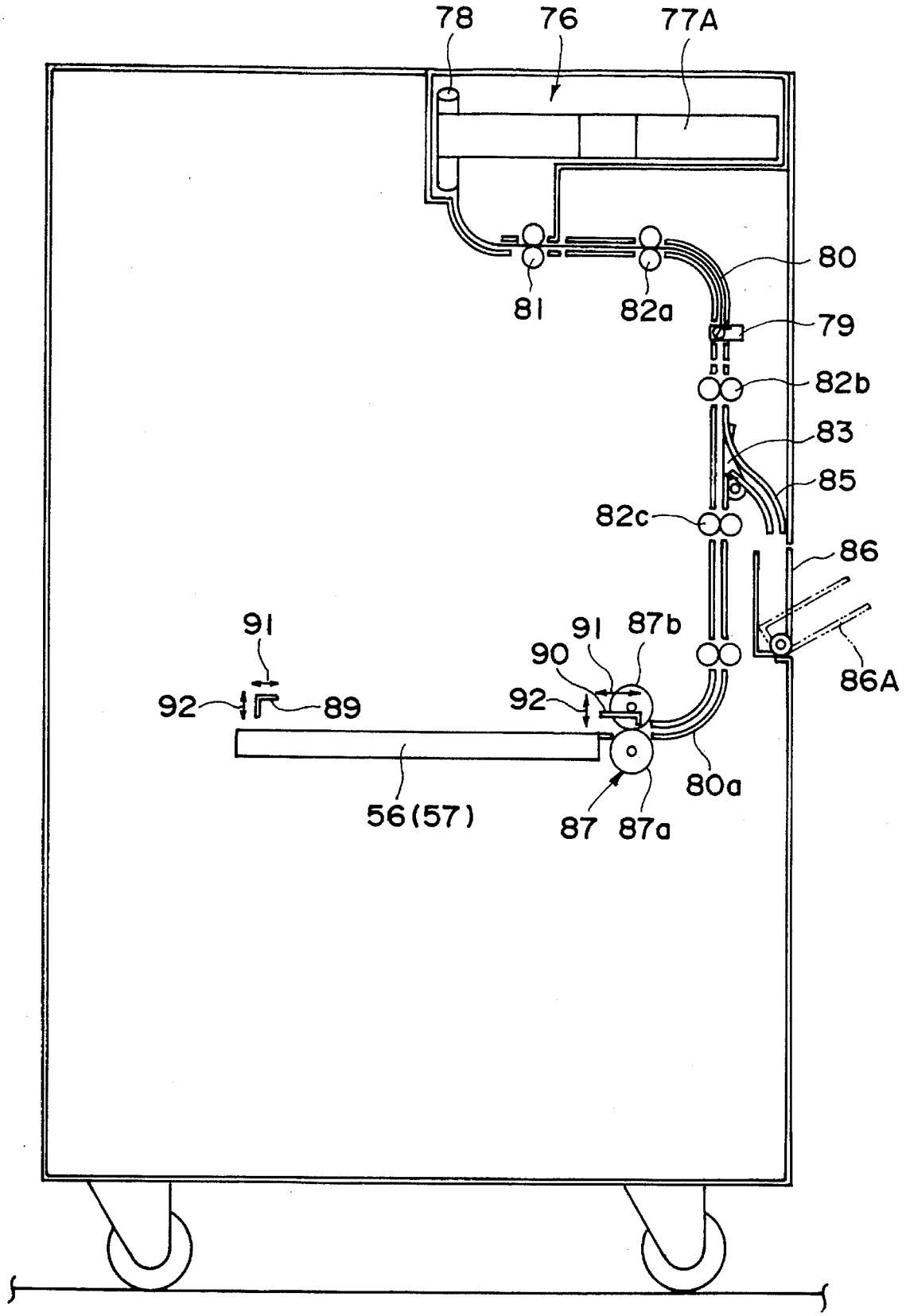
FIG. 3 is a front view of a tape supply portion.

FIG. 3 is a front view showing a convey path for the bind tape 77. The bind tape 77 unwound from the tape reel 77A is fed out by a pair of feed rollers 81 and is guided downwardly along a guide path 80. Between a pair of convey rollers 82*b* and a pair of convey rollers 82*c* which are arranged in the convey path 80 on the way, a dust path 85 is branched from the convey path 80 and a flapper 83 serves to switch to the dust path. A dust box 86 is disposed below the dust path 85 and can be rocked out of the apparatus. A pair of tape supply rollers (tape supply means) 87 comprising a rubber roller 87*a* and an urging roller 87*b* is arranged in the proximity of a lower end 80*a* of the convey path 80.

The first or second tape heating apparatus 56 or 57 is positioned at a tape supply position $A_1$ (FIG. 24) opposed to the pair of tape supply rollers 87 to receive the tape 77. A finger 89 for regulating a tip end of the supplied tape and a finger 90 for regulating a trailing end of the supplied tape can be shifted in directions shown by the arrows 91, 92, respectively.

Figure 4:
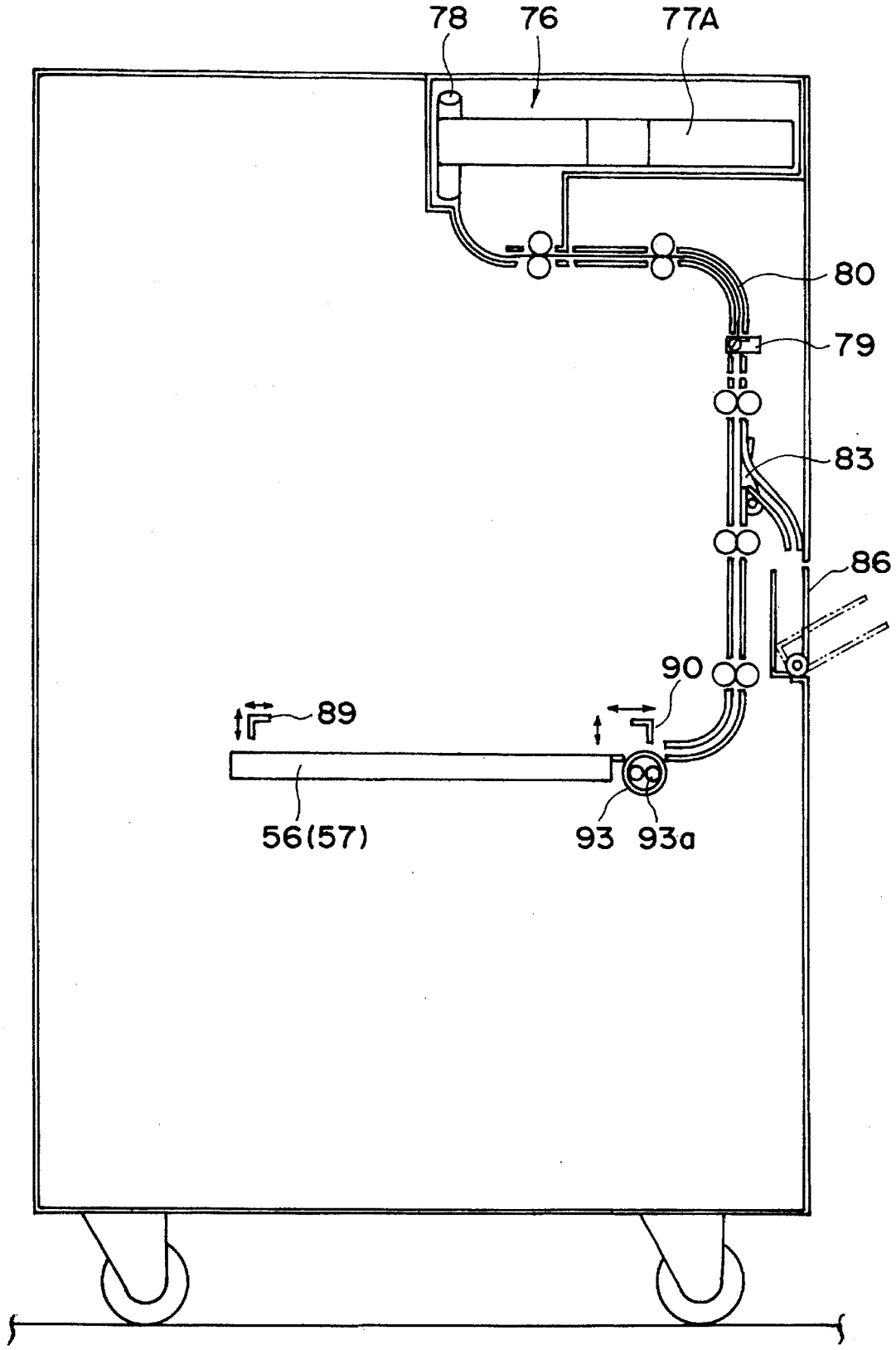
FIG. 4 is a front view of a tape supply portion according to an alteration.

FIG. 4 shows another tape supply means for directing the bind tape 77 conveyed through the convey path 80 to the tape heating apparatus 56 (57). In FIG. 4, a hollow roller 93 having a vacuum fan 93*a* therein is arranged in the proximity of the lower end 80*a* of the convey path 80. A number of air suction holes (not shown) are formed in a peripheral surface of the hollow roller 93 so that the bind tape is supplied to the tape heating apparatus 56 (57) while absorbing the tape by the hollow roller.

Figure 5:
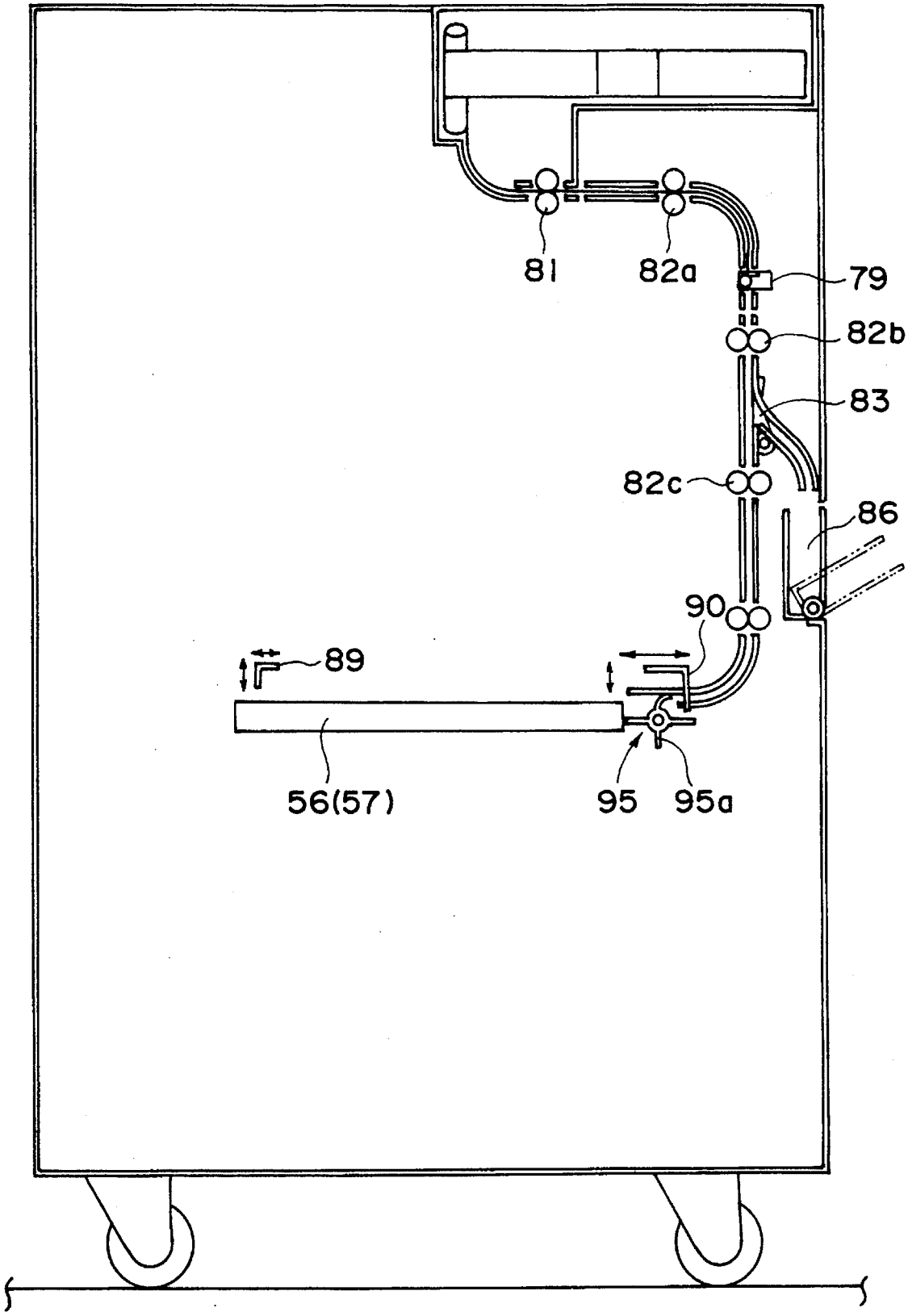
FIG. 5 is a front view of a tape supply portion according to another alteration.

FIG. 5 shows a further tape supply means having a paddle 95 which can apply a small conveying force to the bind tape 77. The paddle 95 has a plurality of elastic plates 95*a* having high coefficient of friction so that the bind tape separated from the tape supply means 87 or 93 can be conveyed with the small conveying force.

Figure 6A:
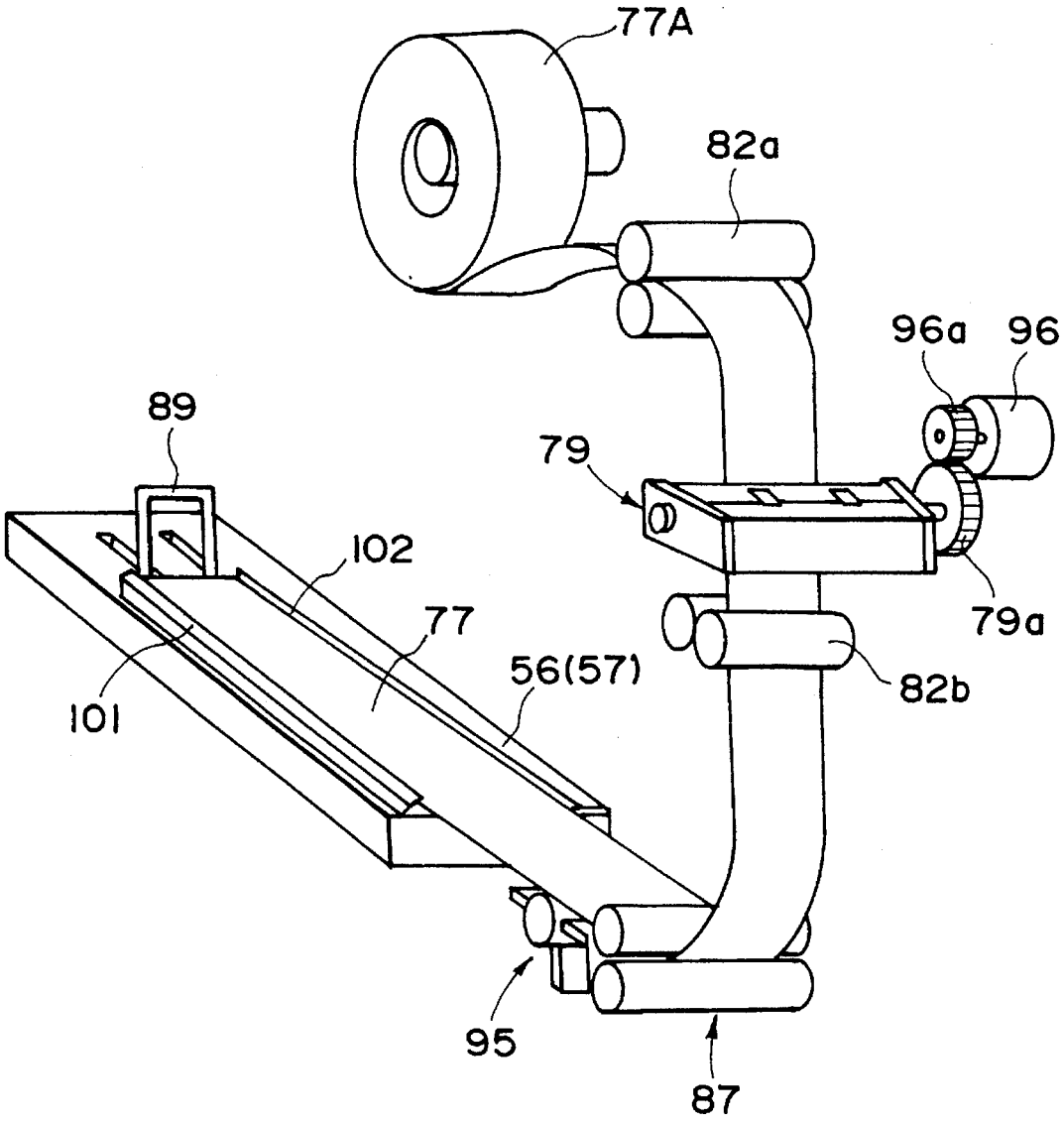
FIG. 6A is a perspective view of the tape supply portion.
Figure 6B:
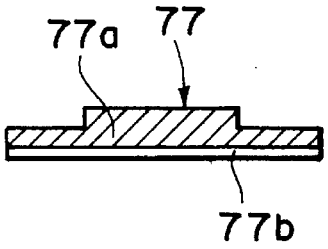
FIG. 6B is a sectional view of a bind tape.

FIG. 6A is a perspective view of a tape supply portion, and FIG. 6B is a sectional view of the bind tape 77.

The cutter 79 has a rotary cutter (not shown), and a gear 79*a* secured to a shaft of the rotary cutter is meshed with an output gear 96*a* of a motor 96. Incidentally, a detection sensor (not shown) is arranged in the convey path 80 in place to detect the presence/absence and length of the bind tape 77. If the length of the bind tape 77 cut by the cutter 79 is smaller than a predetermined value, the cut bind tape 77 is discharged into the dust box 86 through the dust path 85. The dust box 86 is rocked as shown in FIG. 3 at 86A so that the useless bind tape 77 can be removed.

The tape heating apparatus 56 (57) is provided with a pair of left and right guide members 101, 102 which will be described later so that the bind tape 77 supplied by the tape supply rollers 87 and the paddle 95 is guided by the guide members 101, 102 and is positioned at a predetermined position by the fingers 89, 90. As shown in FIG. 6B, the bind tape 77 comprises a flexible substrate film 77*b* and an adhesive layer 77*a* of hot melt type adhered to the substrate film. The bind tape 77 supplied onto the tape heating apparatus 56 (57) is previously heated by the tape heating apparatus 56 (57). Incidentally, a bind tape on which adhesive capable of adhering under the room temperature is coated may be used. In this case, in place of the tape heating apparatus, an urging means for urging the bind tape against the end face of the sheet bundle should be provided.

Figure 7A:
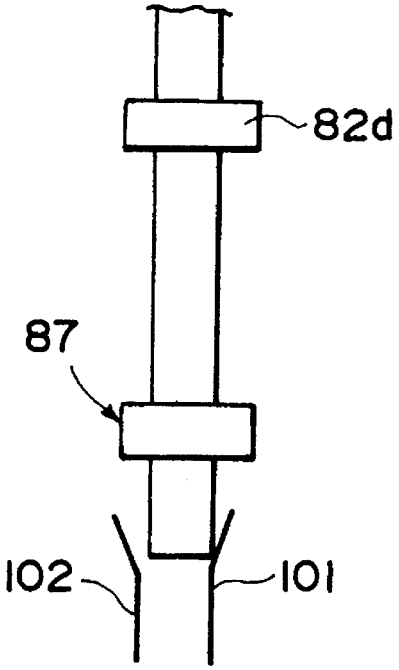
FIG. 7A is a development view of a lower portion of a bind tape path.
Figure 7B:
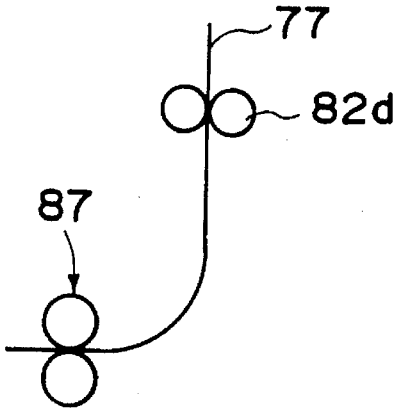
FIG. 7B is a side view of such a lower portion.

FIG. 7A is a development view of the bind tape 77 and the guide members 101, 102 at the tape supply portion, and FIG. 7B is a side view showing the elements of FIG. 7A.

Figure 8:
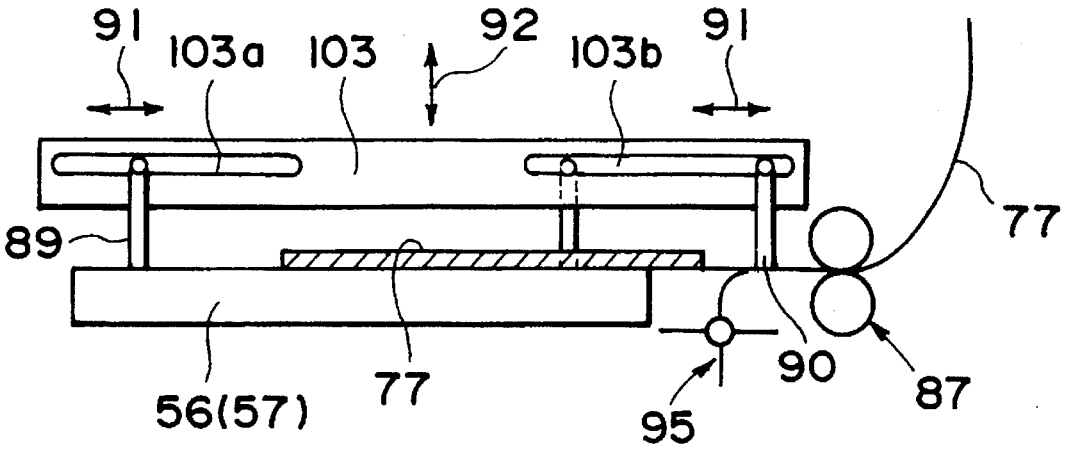
FIG. 8 is a side view of a tape heating apparatus and a positioning member at a tape supply position.
Figure 9:
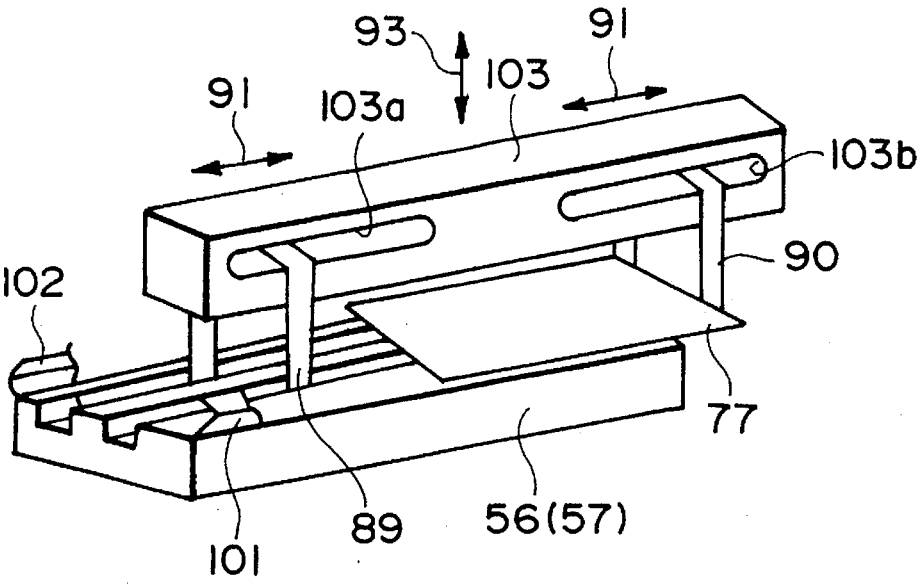
FIG. 9 is a perspective view of the elements of FIG. 8.

In FIGS. 8 and 9, the fingers 89, 90 can be shifted in a front and Pear direction shown by the arrows 91 along elongated slots 103*a*, 103*b* formed in a positioning member 103, thereby positioning the supplied bind tape 77 onto the tape heating apparatus 56 (57). After the positioning operation, the positioning member 103 is shifted in an upward direction shown by the arrow 93 to be retarded from the tape.

Figure 10:
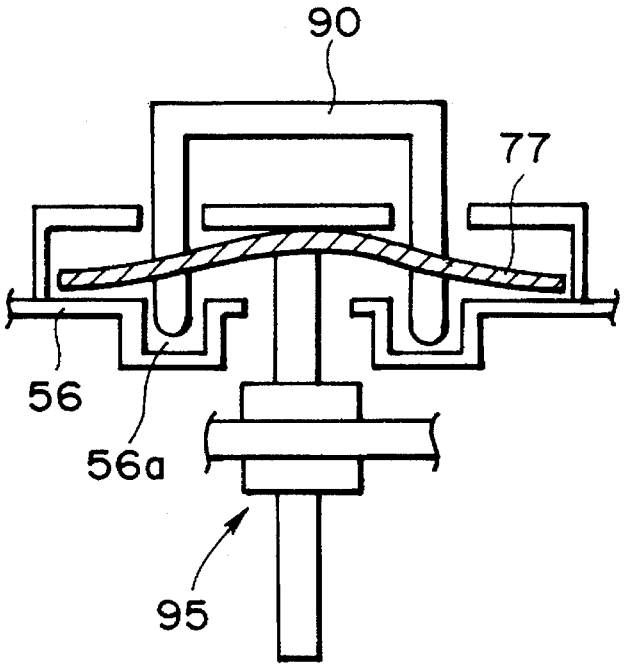
FIG. 10 is a sectional view of a table guide portion.
Figure 11:
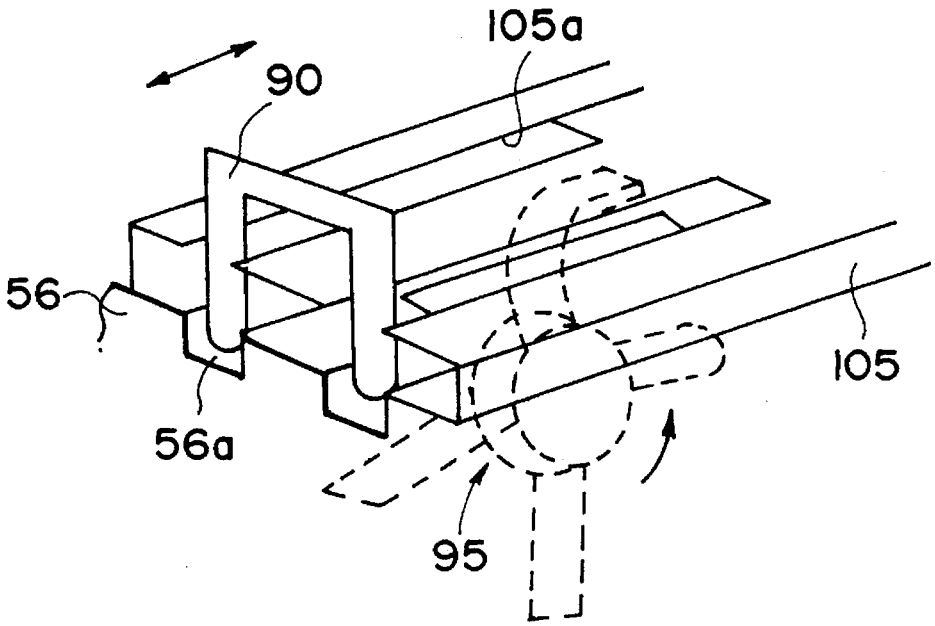
FIG. 11 is a perspective view of the table guide portion.

In FIGS. 10 and 11, a table guide 105 extends from a lower end of the upper guide plate defining the convey path 80 and is provided with slots 105*a* within which the finger 90 can be freely moved. Further, the table guide 105 is overlapped with the end portion of the first tape heating apparatus 56 so that the lower end of the finger 90 can be freely moved within grooves 56*a* formed in the tape heating apparatus 56. With this arrangement, the trailing end of the bind tape 77 fed out by the paddle 95 is further shifted toward the first tape heating apparatus 56 and is positioned there.

Figure 12:
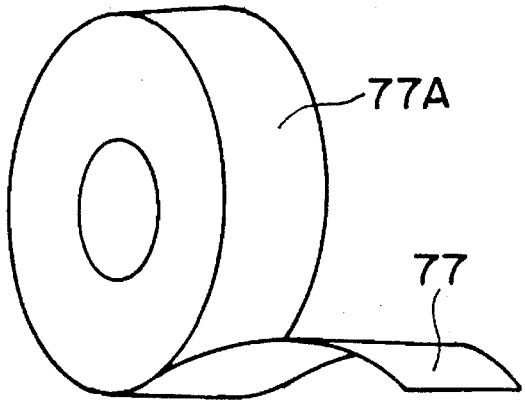
FIG. 12 is a perspective view of tape reels.
Figure 13:
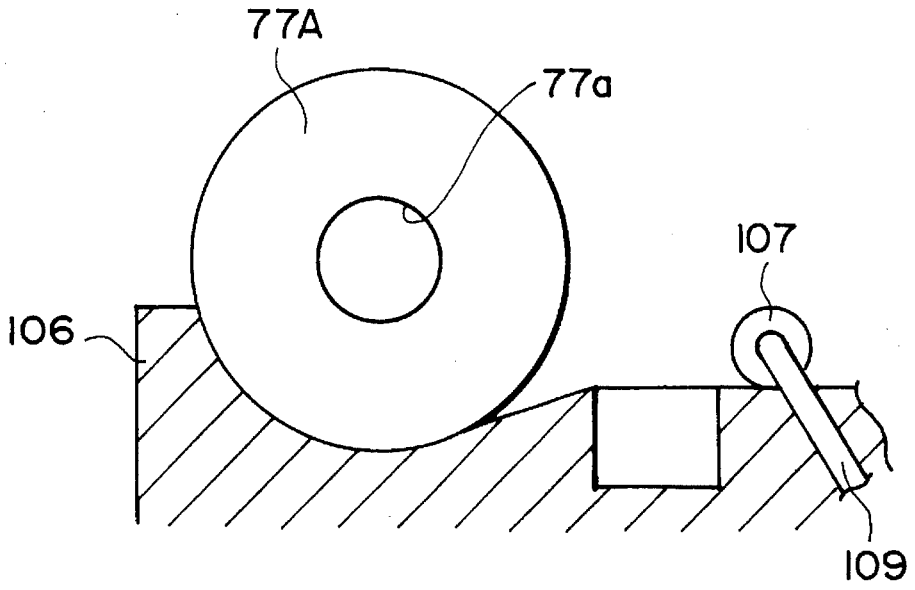
FIG. 13 is a side view of a supporting member for supporting a plurality of tape reels.
Figure 14:
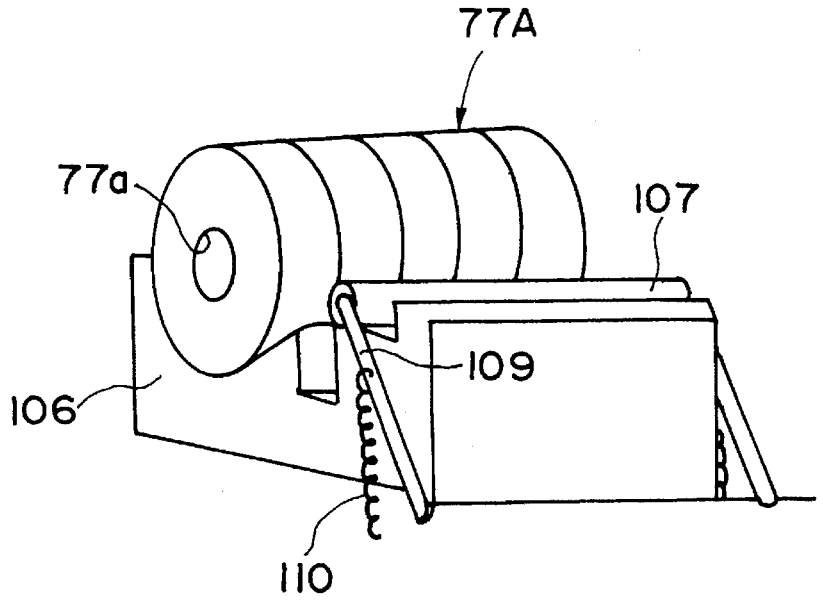
FIG. 14 is a perspective view of the supporting member.

In FIGS. 13 and 14, a plurality of tape reels 77A shown in FIG. 12 are housed side by side in a recess formed in a support member 106. The bind tape 77 supplied from the tape reel 77A is urged against the support member 106 by a hold-down roller 107. A pair of support levers 109 for rotatably supporting the hold-down roller 107 is biased by a tension spring 110 to lower the hold-down roller 107.

Figure 15:
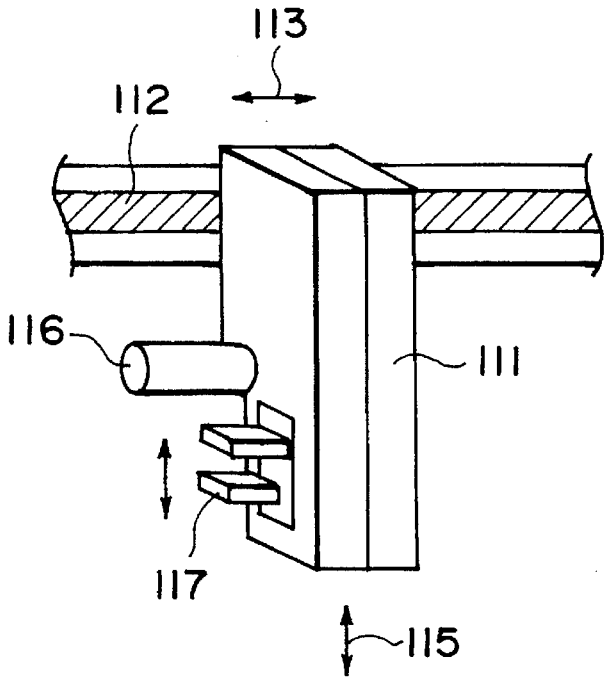
FIG. 15 is a side view of a movable member portion.

A movable member 111 (FIG. 15) is arranged at one end of an array of the tape reels 77A. The movable member 111 is provided at its side surface with a support shaft 116 for supporting a core 77*a* of the tape reel 77A and a pair of guide plates 117 for guiding the bind tape 77 supplied from the tape reel 77A. Further, the movable member 111 has a pinion (not shown) meshed with a rack 112 so that the movable member is reciprocally shifted in directions shown by the arrow 113 by rotation of the pinion. Further, the movable member 111 can be shifted in directions shown by the arrow 115 via a supporting means (not shown).

Figure 16:
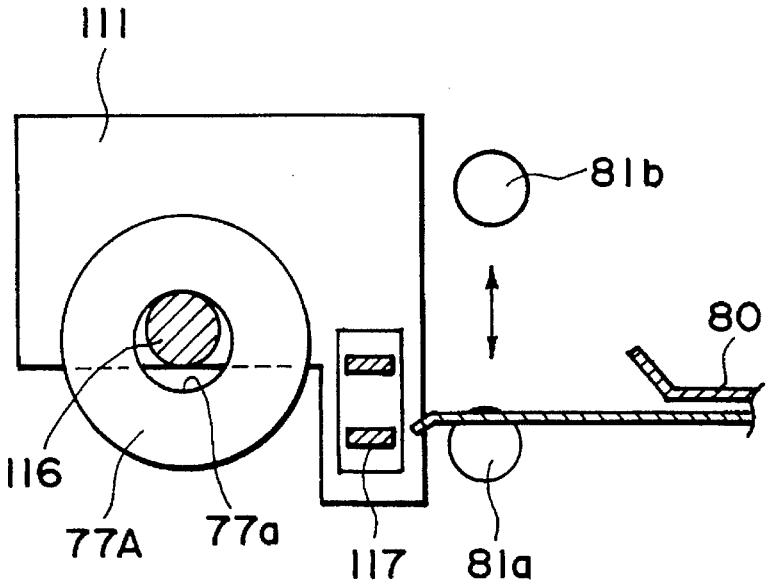
FIG. 16 is a front view of the support member for supporting a plurality of tape reels.

FIG. 16 shows a condition that the bind tape 17 of the tape reel 77A is set in the pair of feed rollers 81 of the tape unit 76. When the bind tape 77 is set, a driven roller 81*b* of the pair of feed rollers 81 is retarded upwardly. In this condition, the end of the bind tape 77 is inserted between the pair of feed rollers 81 and is positioned between the pair of guide plates 117 and the pair of feed rollers 81. Then, the driven roller 81*b* is urged against a drive roller 81*a* again. In this condition, when the pair of feed rollers 81 are rotated, the bind tape 77 of a new tape reel 77A can be supplied into the convey path 80.

Figure 17A:
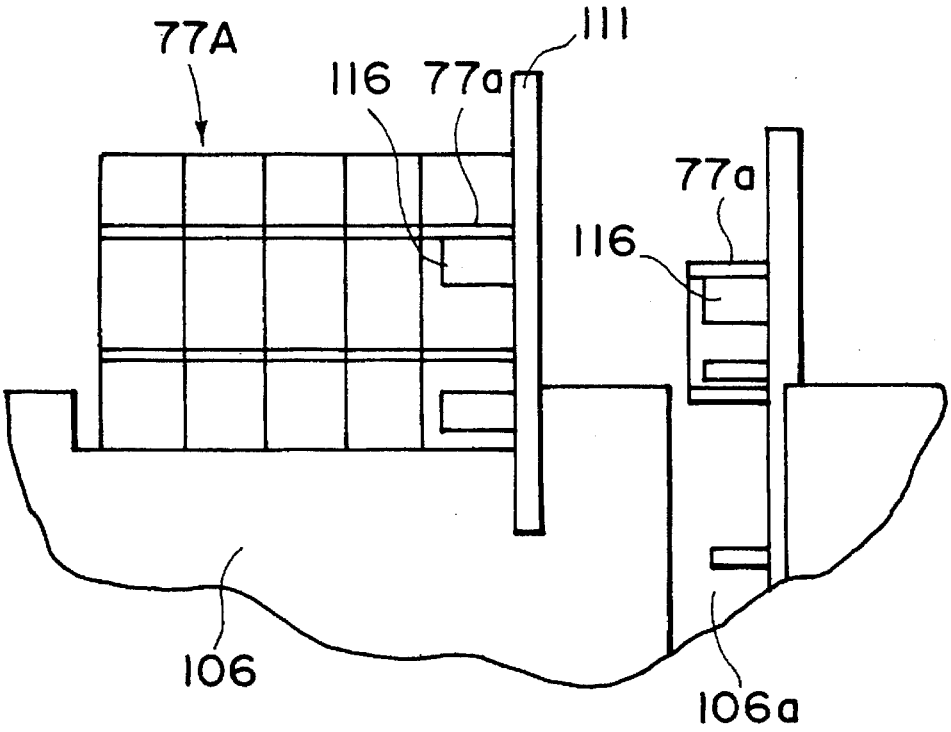
FIG. 17A is a front view of the support member and a tape reel portion.
Figure 17B:
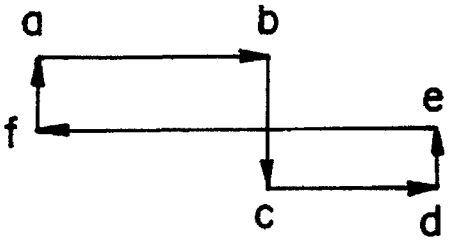
FIG. 17B is a view showing shifting directions of the support member.

In FIG. 17A, in a condition that the tape reel 77A is supported by the movable member 111, the support member 106 is shifted upwardly (between f–a in FIG. 17B) and then is shifted to the right (between a–b in FIG. 17B). In this condition, the tape reel 77A is housed in the recess 106*a* of the support member 106 to permit the supplying of the bind tape 77.

Figure 18A:
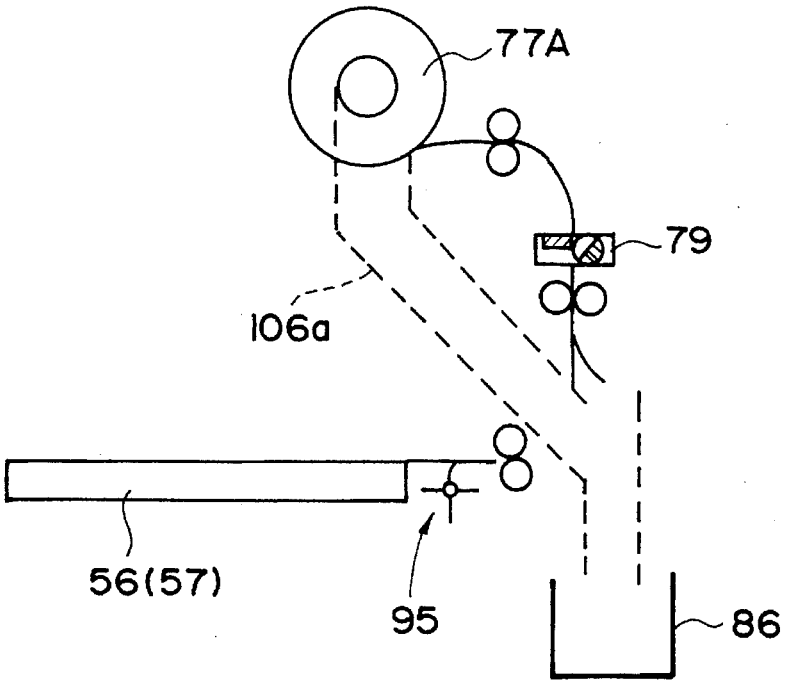
FIG. 18A is a front view of a discharge path.
Figure 18B:
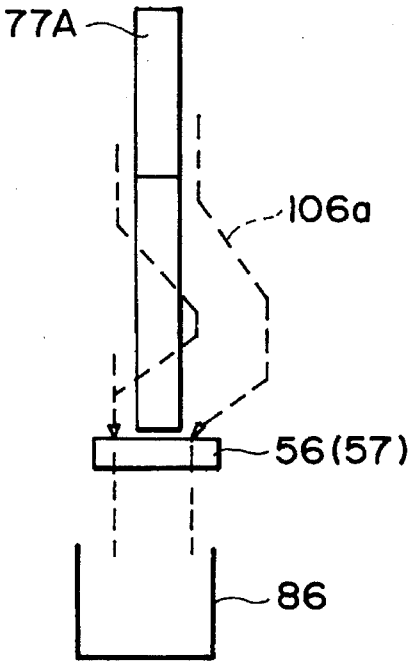
FIG. 18B is a side view of the discharge path.

When the bind tape 77 is used up, the movable member 111 is lowered (i.e., shifted between b–c in FIG. 17B) and then is shifted to the right (between c–d in FIG. 17B), with the result that the core 77*a* of the tape reel 77A is dropped into the recess 106*a* to be sent to the dust box 86. Then, after the movable member 111 is lifted (between d–e in FIG. 17B), it is shifted to the left (between e–f in FIG. 17B), with the result that the support shaft 116 of the movable member 111 enters into a new tape reel 77A and supports the reel. FIG. 18A is a front view of the recess 106*a* and the dust box 86, and FIG. 18B is a side view oft the recess and the dust box.

Figure 19:
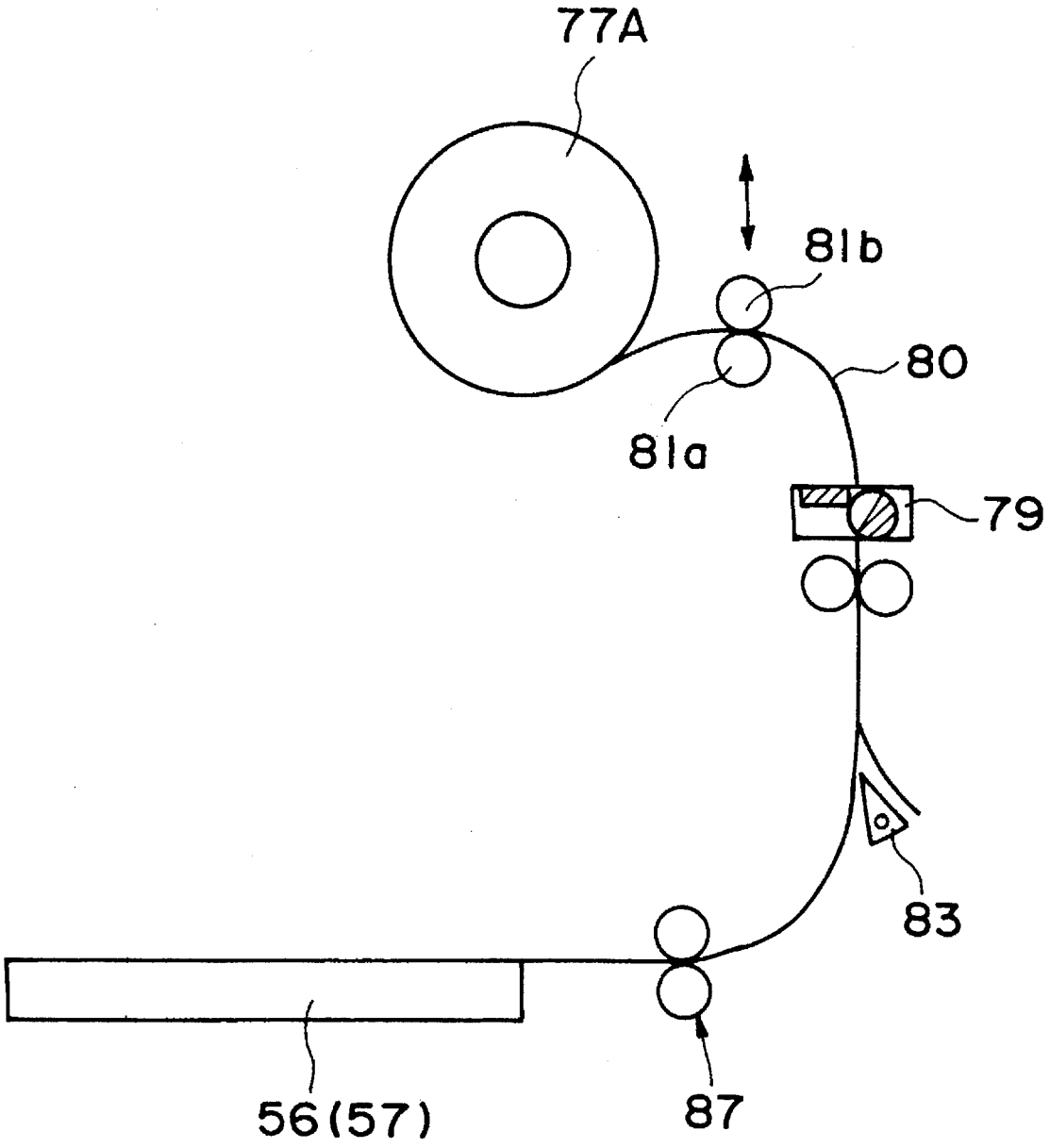
FIG. 19 is a front view of the bind tape path.

FIG. 19 shows the convey path for the bind tape 77. The convey path is arranged not to intersect with the recess 106*a* shown in FIG. 18A.

Figure 20:
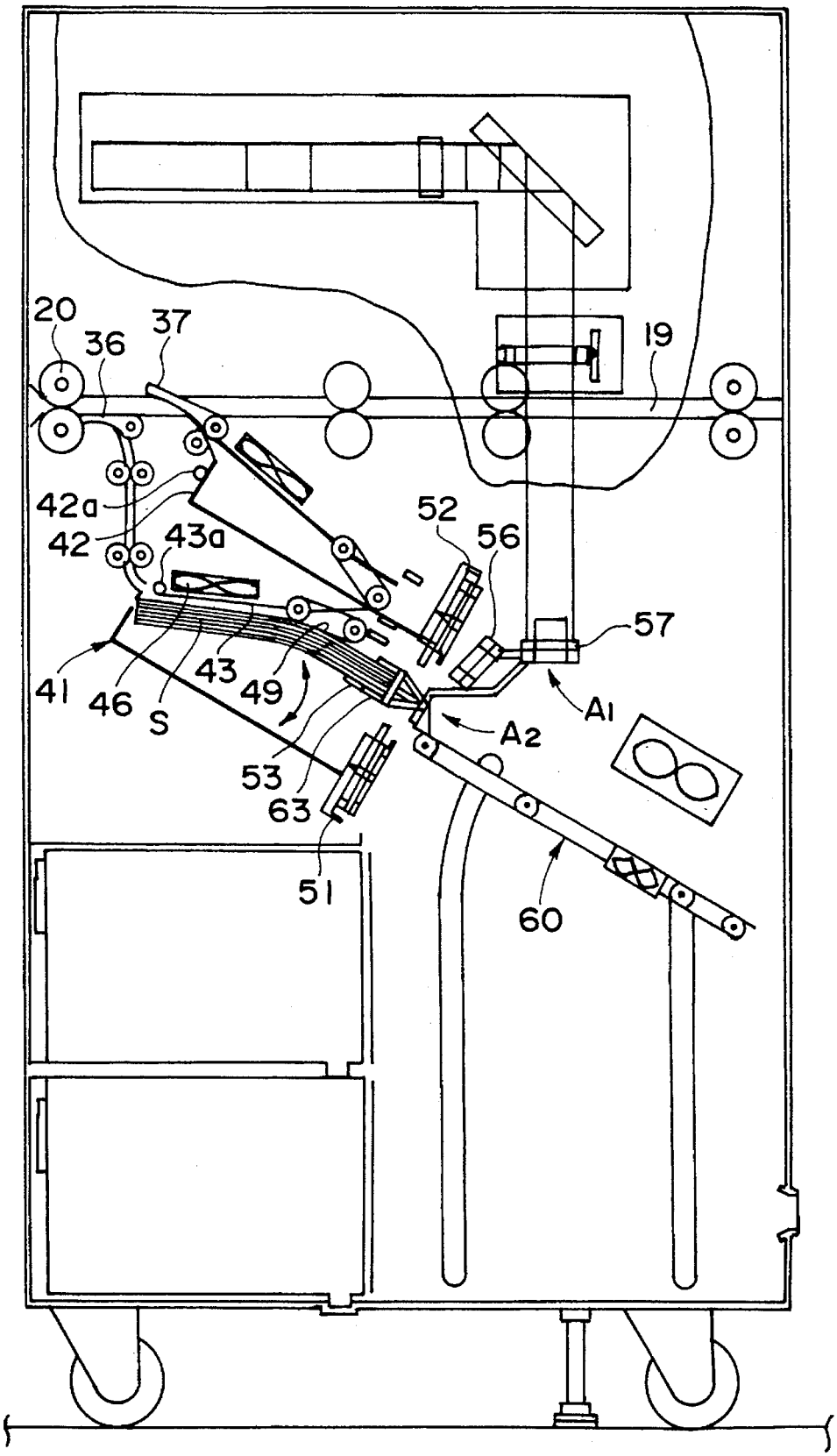
FIGS. 20 to 23 ape sectional side views of a bookbinding apparatus.
Figure 21:
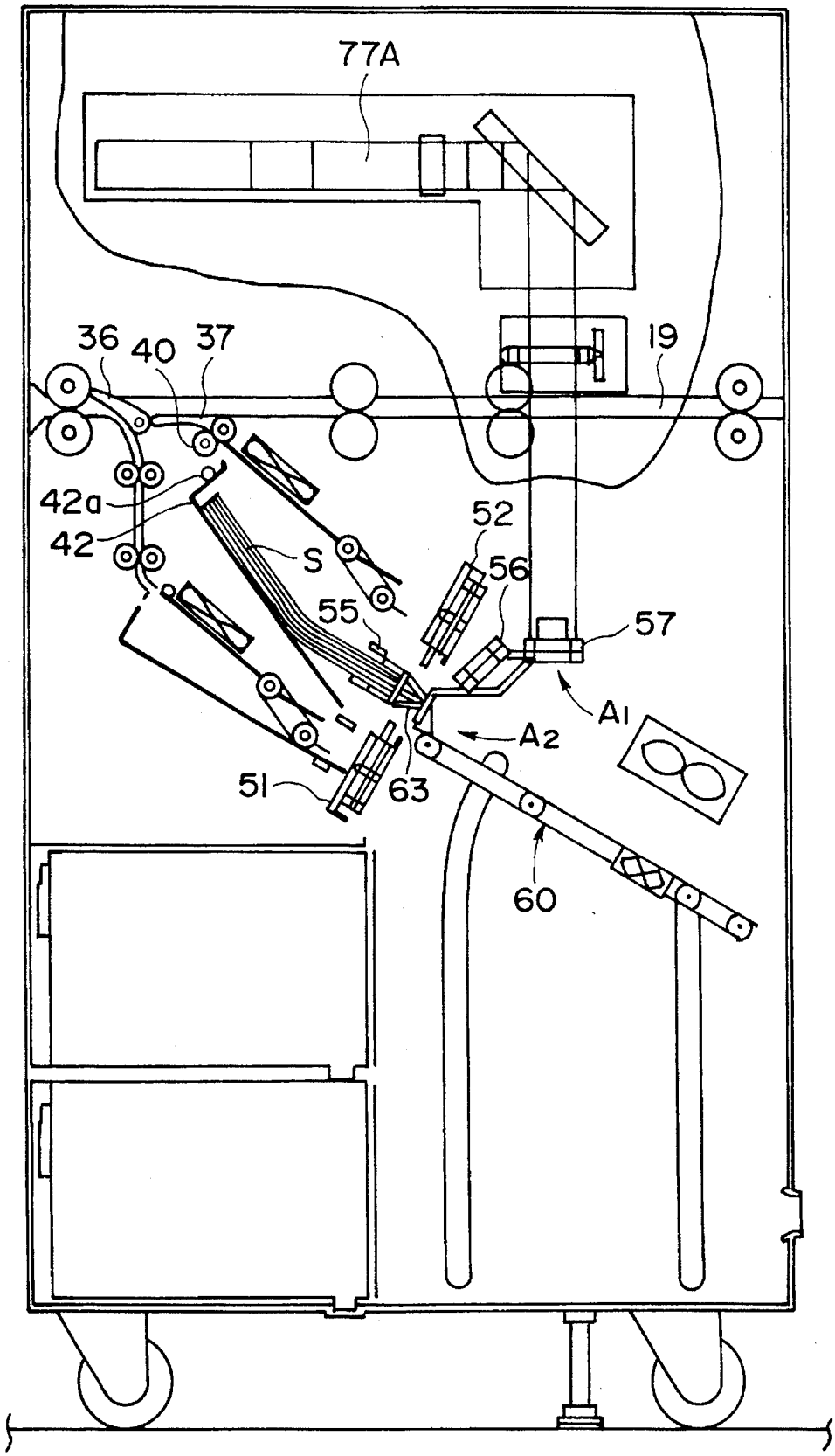
Figure 22:
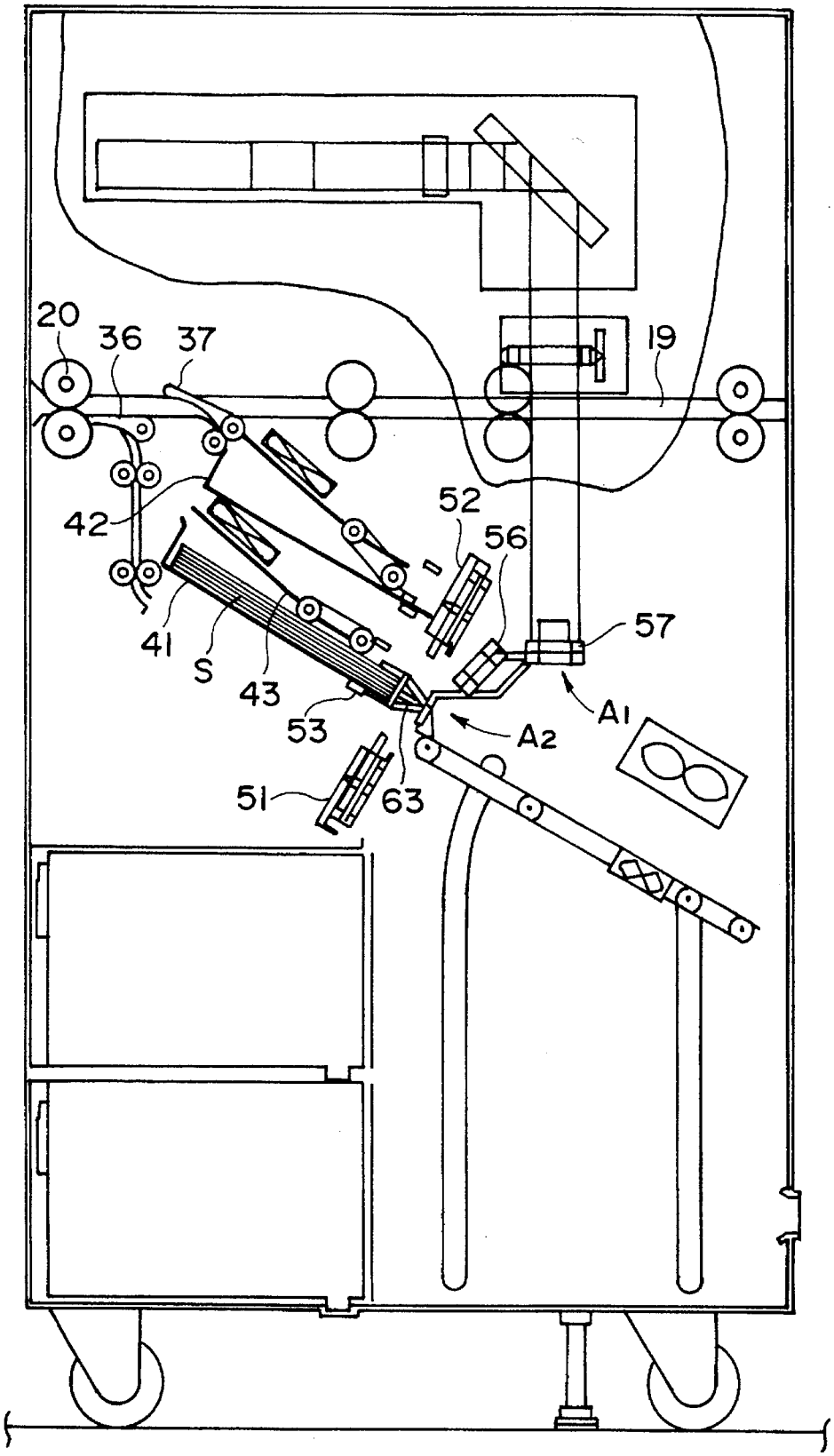
Figure 23:
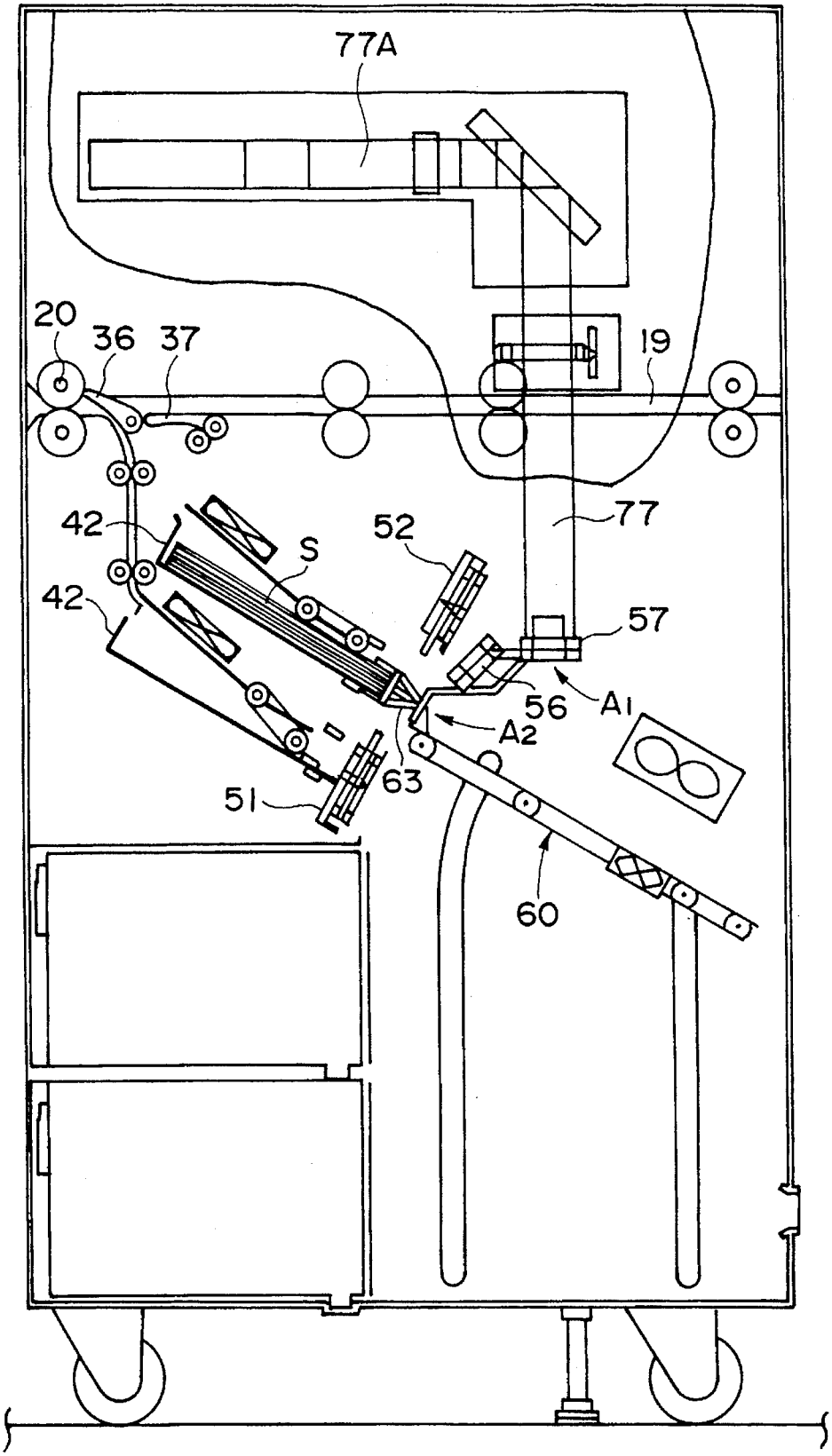

Next, the setting of the sheet bundle to the tape heating apparatus positioned at a back abutment position (bind position) $A_2$ will be explained. FIGS. 20 and 21 show a system wherein the sheet align tray is stationary and the sheet bundle is set by the clamp member, and FIGS. 22 and 23 show a system wherein the sheet bundle is set by shifting the sheet align tray.

In FIG. 20, the sheet bundle sent in the first sheet align tray 41 is clamped by the clamping member 53 and is shifted to the back abutment position $A_2$ defined by central portions of the abutment members 51, 52. In this case, the upper guide plate 43, sweeping and collecting member 49 and fan 46 are retarded upwardly around a rotary shaft 43*a*. In this case, the first flapper 36 is closed toward the first sheet align tray 41 to prevent the succeeding sheets S from entering into the first sheet align tray 41, and the second flapper 37 is opened toward the sheet convey path 19 to direct the succeeding sheets S to the second sheet align tray 42.

Incidentally, FIGS. 20 to 23 show a condition that, after the sheet bundle is bookbound by the first tape heating apparatus 56 positioned at the back abutment position $A_2$, the first tape heating apparatus 56 is retarded and the clamping members 53, 55 are opened so that the sheet bundle is handled by the handling member 63.

FIG. 21 shows a condition that the sheet bundle in the second sheet align tray 42 is set in the back abutment position $A_2$. The sheet bundle positioned by the clamping member 55 is shifted to the back abutment position $A_2$ by shifting the clamping member 55 to the center. In this case, the lower guide oft the second sheet align tray 42 is also rotated around a rotary shaft 42*a* to be retarded downwardly.

FIG. 22 shows a condition that the sheet bundle in the first sheet align tray 41 is shifted to the back abutment position $A_2$. The first sheet align tray 41 containing the sheet bundle is translated to the center, thereby shifting the sheet bundle to the back abutment position $A_2$.

FIG. 23 shows a condition that the sheet bundle in the second sheet align tray 42 is shifted to the back abutment position $A_2$. The second sheet align tray 42 containing the sheet bundle is translated to the central back abutment position $A_2$, thereby shifting the sheet bundle to the back abutment position $A_2$.

Figure 24:
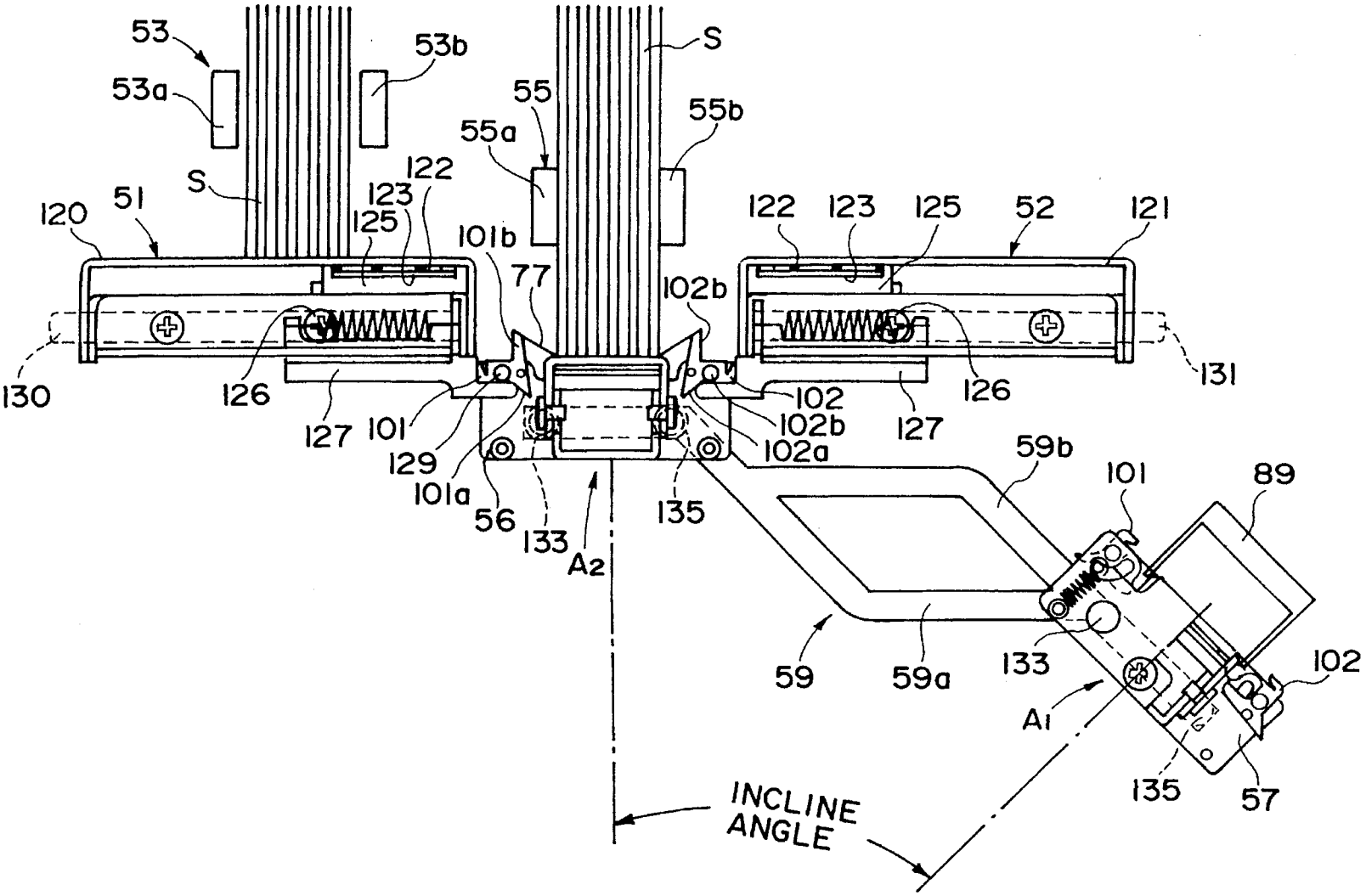
FIG. 24 is a front view showing abutment members, heating apparatuses and a pass-by path.

In FIG. 24, two tape heating apparatuses as the second heating means are provided. One of them, i.e. the first tape heating apparatus 56 already received the bind tape 77 and is positioned at the back abutment position $A_2$.

The second tape heating apparatus 57 receives the bind tape 77 at the tape supply position $A_1$ in the manner as mentioned above, and the bind tape is guided by the guide members 101, 102. The second tape heating apparatus 57 positioned at the tape supply position $A_1$ previously heats the received bind tape 77 and is waiting. In the first tape heating apparatus 56 positioned at the back abutment position $A_2$, the pair of guide members 101, 102 ape rotatably mounted on support shafts 129. The first and second abutment members 51, 52 are retractably (to the left and right) supported by guide shafts 130, 131 and ape provided with tape openers 127 biased inwardly (centrally) by tension springs 126.

Between the tape supply position $A_1$ and the back abutment position $A_2$, there is arranged a pass-by path 59 having a plurality of branched pass-by passages 59*a*, 59*b*. The pass-by path 69 comprises guide grooves along which guide rollers 133, 135 of the tape heating apparatus 56, 57 can be guided. When the tape heating apparatus 56 (or 57) is shifted from the tape supply position $A_1$ to the back abutment position $A_2$, the tape heating apparatus passes through the pass-by passage 59*a*; whereas, when the tape heating apparatus is shifted from the back abutment position $A_2$ to the tape supply position $A_1$, the tape heating apparatus passes through the pass-by passage 59*b*. In this way, when the tape heating apparatuses 56, 57 are shifted, they are not struck against each other.

Now, in the condition that the first tape heating apparatus 56 was shifted in the back abutment position $A_2$, when the abutment members 51, 52 are shifted to approach each other, lower ends 101*a*, 102*a* of the guide members 101, 102 are urged by inner ends of the tension springs 126, thereby rotating the guide members by about 90 degrees. As a result, the guiding action of the guide members 101, 102 regarding the bind tape 77 is released. At the same time, upper ends 101*b*, 102*b* of the guide members 101, 102 are lifted to cock both ends of the bind tape 77 as shown.

The second abutment member 52 has a case 121 formed from a radiator plate within which a ceramic heater 122, silicone rubber 123 and an insulation member 125 are arranged to heat the second abutment member 52. Similarly, the first abutment member 51 also has a ceramic heater 122 and the like. The sheet bundle on the second abutment member 52 is previously heated by the ceramic heater 122. This sheet bundle is shifted above the back abutment position $A_2$ by the clamping member 55 pinching the sheet bundle and then is shifted toward the first tape heating apparatus 56 to be abutted against the bind tape 77.

Figure 25:
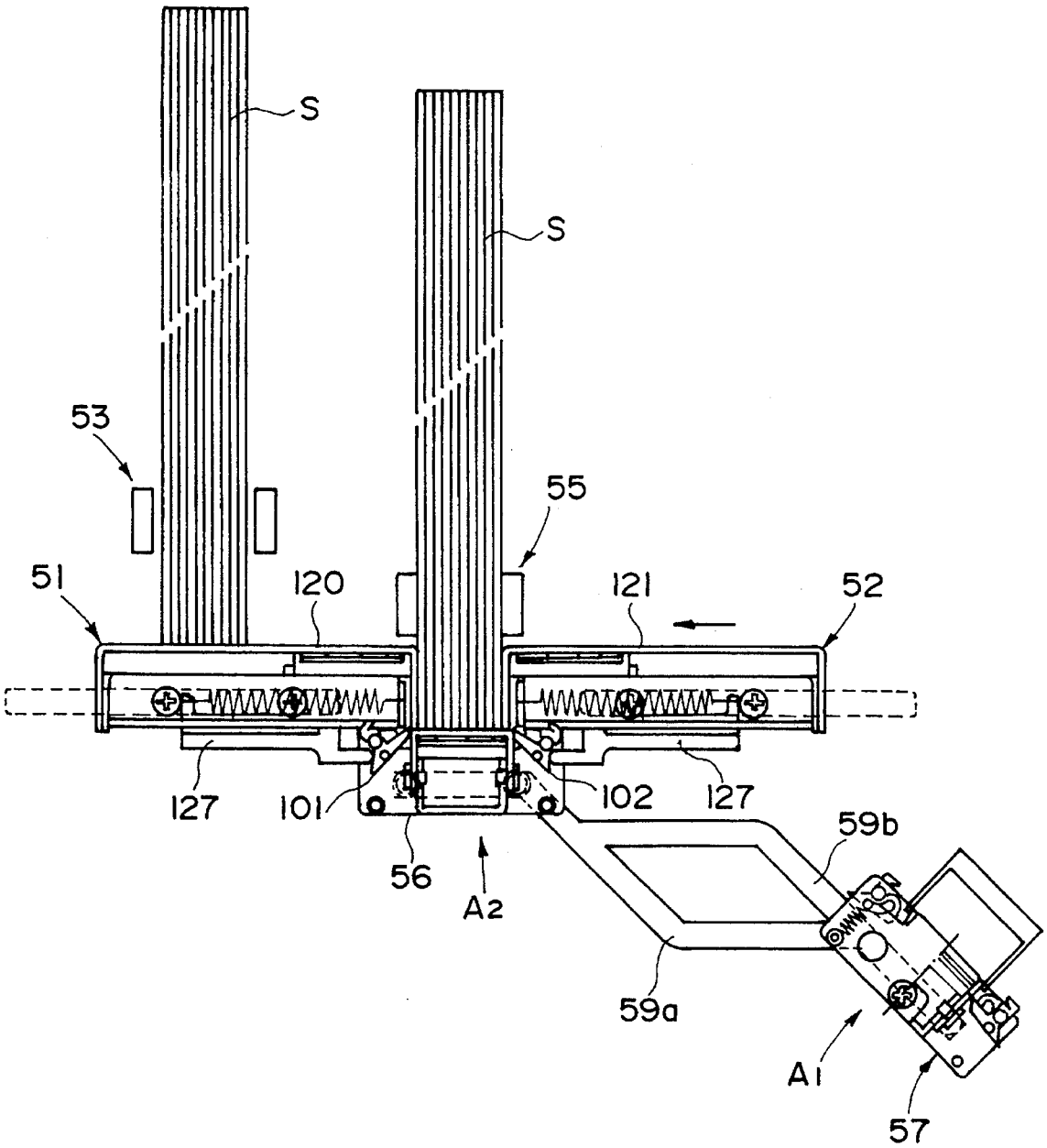
FIG. 25 is a view for explaining the operation of the system of FIG. 24.

In this condition, when the abutment members 51, 52 are approached to each other, as shown in FIG. 24, both ends of the bind tape 77 are cocked. And, by further shifting movements of the abutment members 51, 52, as shown in FIG. 25, both ends of the bind tape 77 are urged against the sheet bundle by the inner surfaces of the cases 120, 121 thereby adhering the bind tape 77 to side surfaces of the sheet bundle.

After the bind tape 77 is adhered to the sheet bundle, the first tape heating apparatus 56 positioned in the back abutment position $A_2$ is shifted toward the tape supply position $A_1$ through the pass-by passage 59*b* of the pass-by path 69. Then, the tape heating apparatus 56 receives the bind tape 77 at that tape supply position. On the other hand, the second tape heating apparatus 57 which was preheated and to which the bind tape 77 was supplied at the tape supply position $A_1$ during the bookbinding of the sheet bundle is shifted toward the back abutment position $A_2$ through the pass-by passage 59*a* of the pass-by path 69. Then, the sheet bundle preheated at the first abutment member 51 is handled by the second tape heating apparatus 57 in the same manner as mentioned above, thereby bookbinding the sheet bundle.

In this way, by aligning the tip ends of the sheets and previously heating the sheet bundles by using two abutment members, the inconvenience caused when the sheet bundle is heated from the room temperature can be eliminated and the bookbinding time can be reduced. Further, while the bookbinding operation is effected at the back abutment position $A_2$, since the bind tape 77 is supplied and is preheated at the tape supply position $A_1$, the time for supplying the bind tape can be reduced and the preheat is not required at the back abutment position $A_2$, thereby reducing the bookbinding time.

Figure 26:
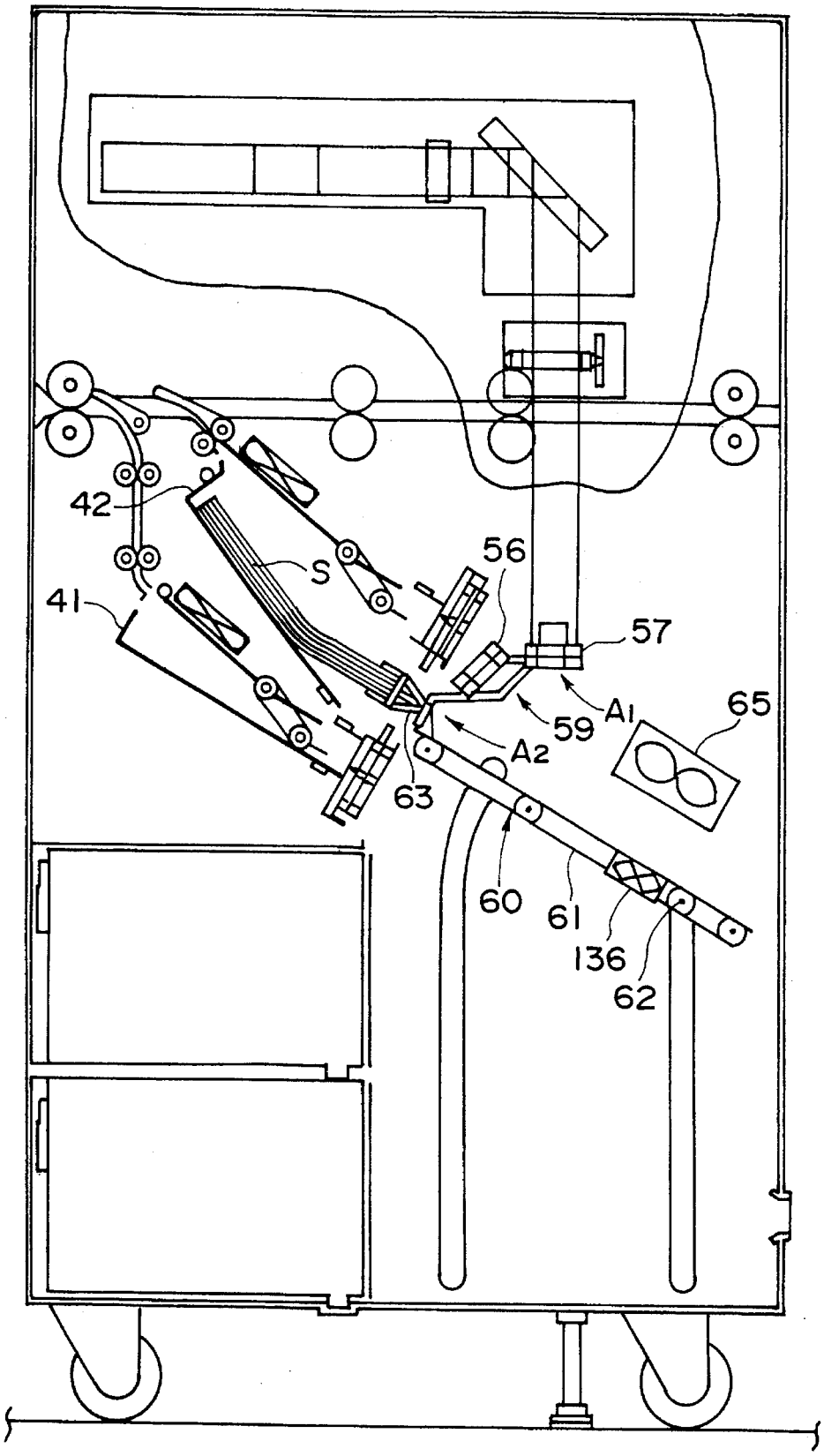
FIG. 26 is a side view of a carriage portion.

In FIG. 26, the carriage 60 a free end of which is positioned at the tape supply position $A_1$ has the convey belt 61, the handling member 63 movable together with the convey belt, and the fan 36 for cooling the bookbound sheet bundle. The carriage 60 is rockable around the roller shaft of the roller 62 between an inclined position as shown and a horizontal position.

Figure 27:
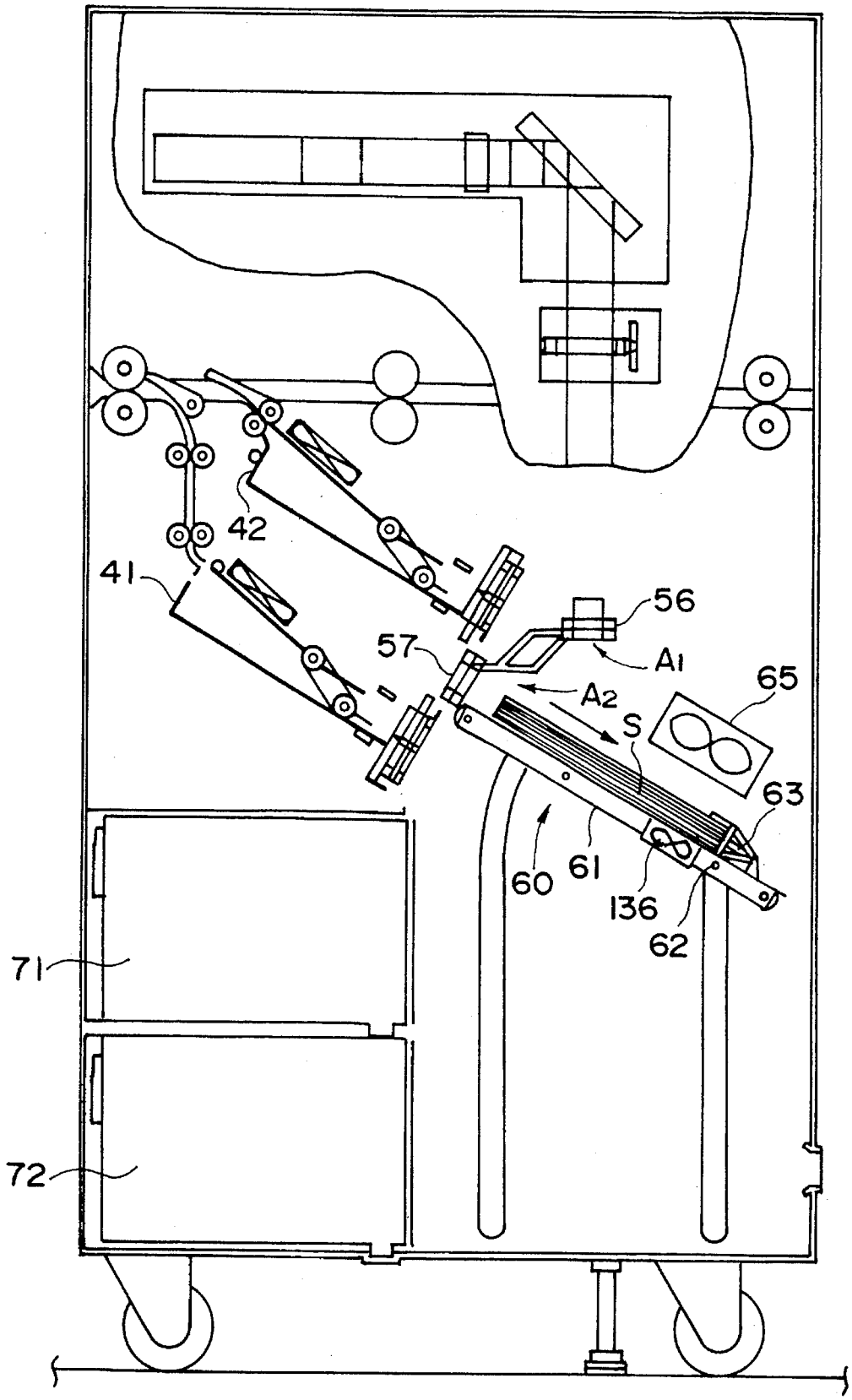
FIGS. 27 to 30 are side views for explaining the operation of the carriage portion.
Figure 28:
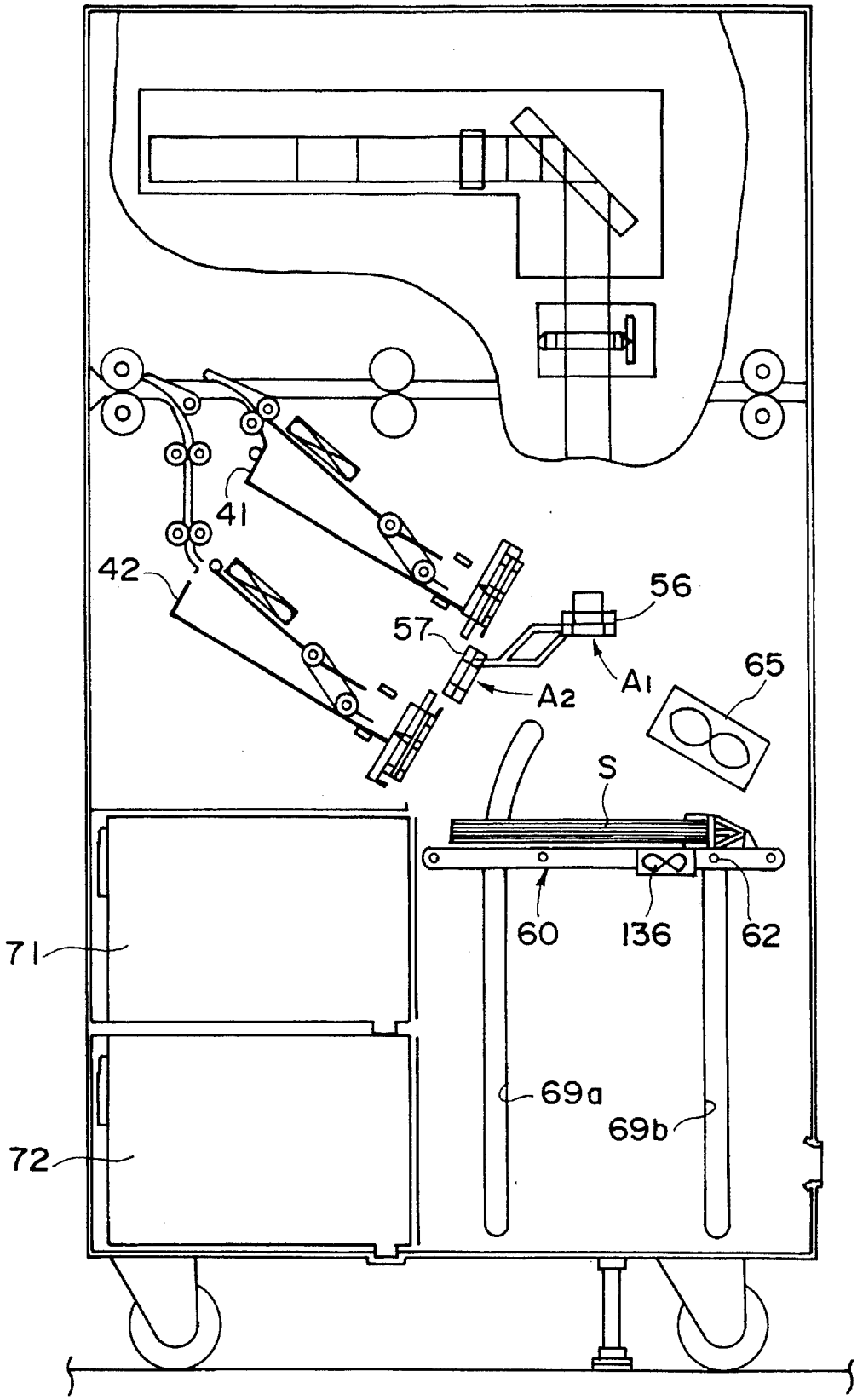
Figure 29:
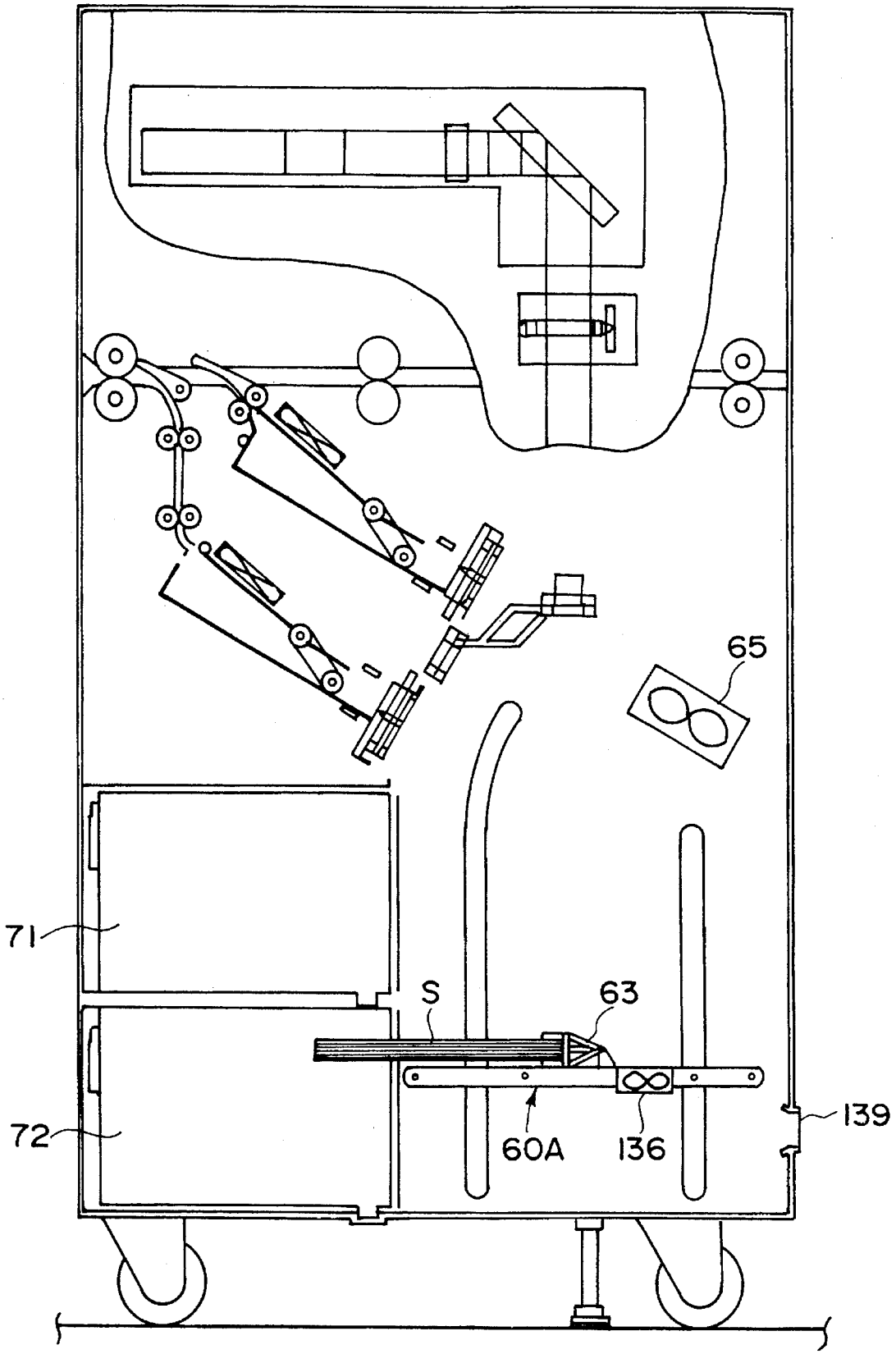

The sheet bundle bookbound at the back abutment position $A_2$ is handled by the handling member 63 and is conveyed by the convey belt 61 to be shifted on the carriage 60 (FIG. 27). As shown in FIG. 29, the carriage 60 is lowered to a predetermined position and is stopped there. Then, the bookbound sheet bundle is contained into the stacker 72 by the convey belt 61. Each of the stackers 71, 72 is provided with a sensor (not shown) for detecting the presene/absence of the bookbound sheet bundle and a sensor (not shown) for detecting a height of the bookbound sheet bundles (i.e. detecting the stacking amount). The carriage 60 is stopped at the position corresponding to the stacking amount.

Figure 30:
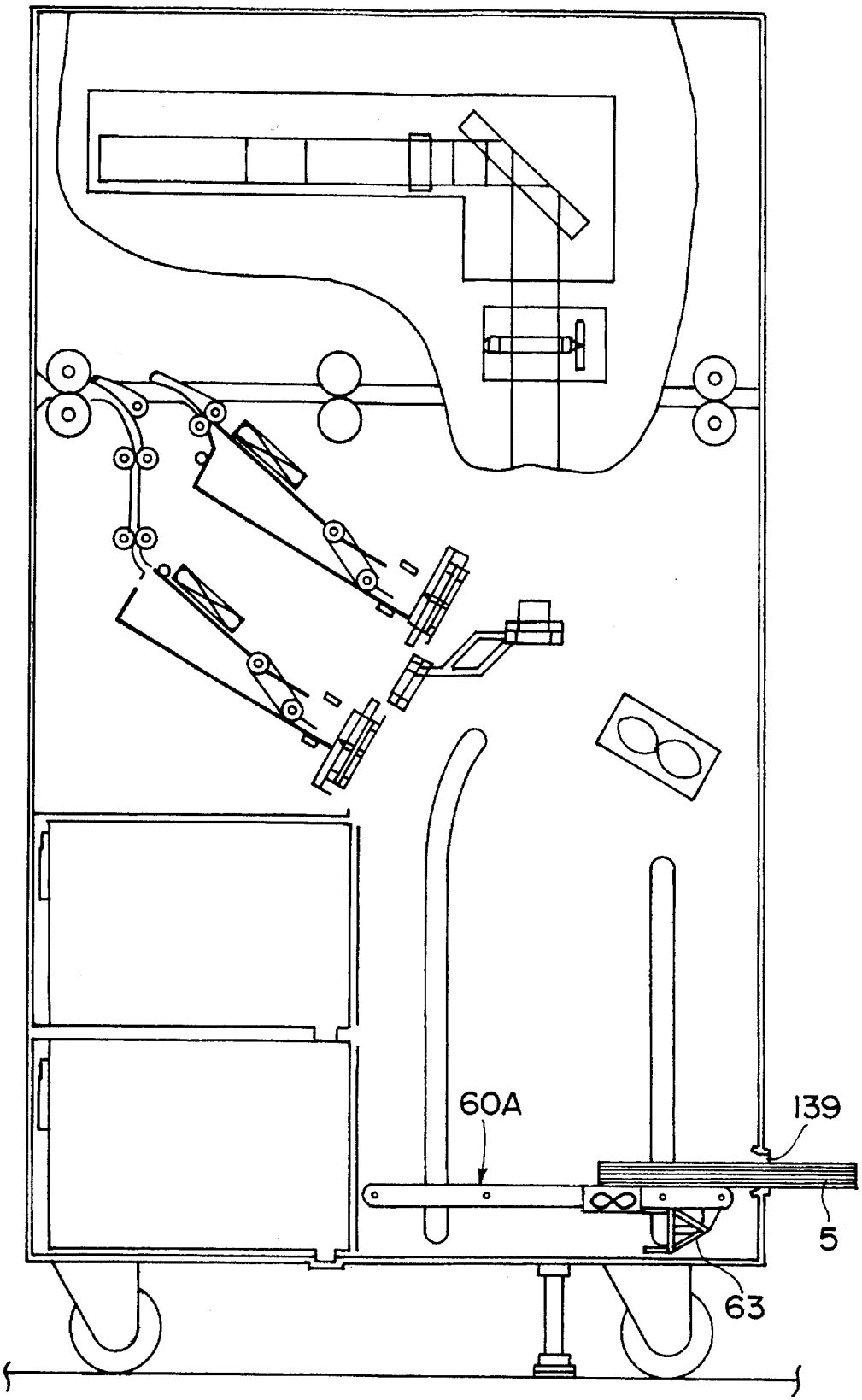
Figure 31:
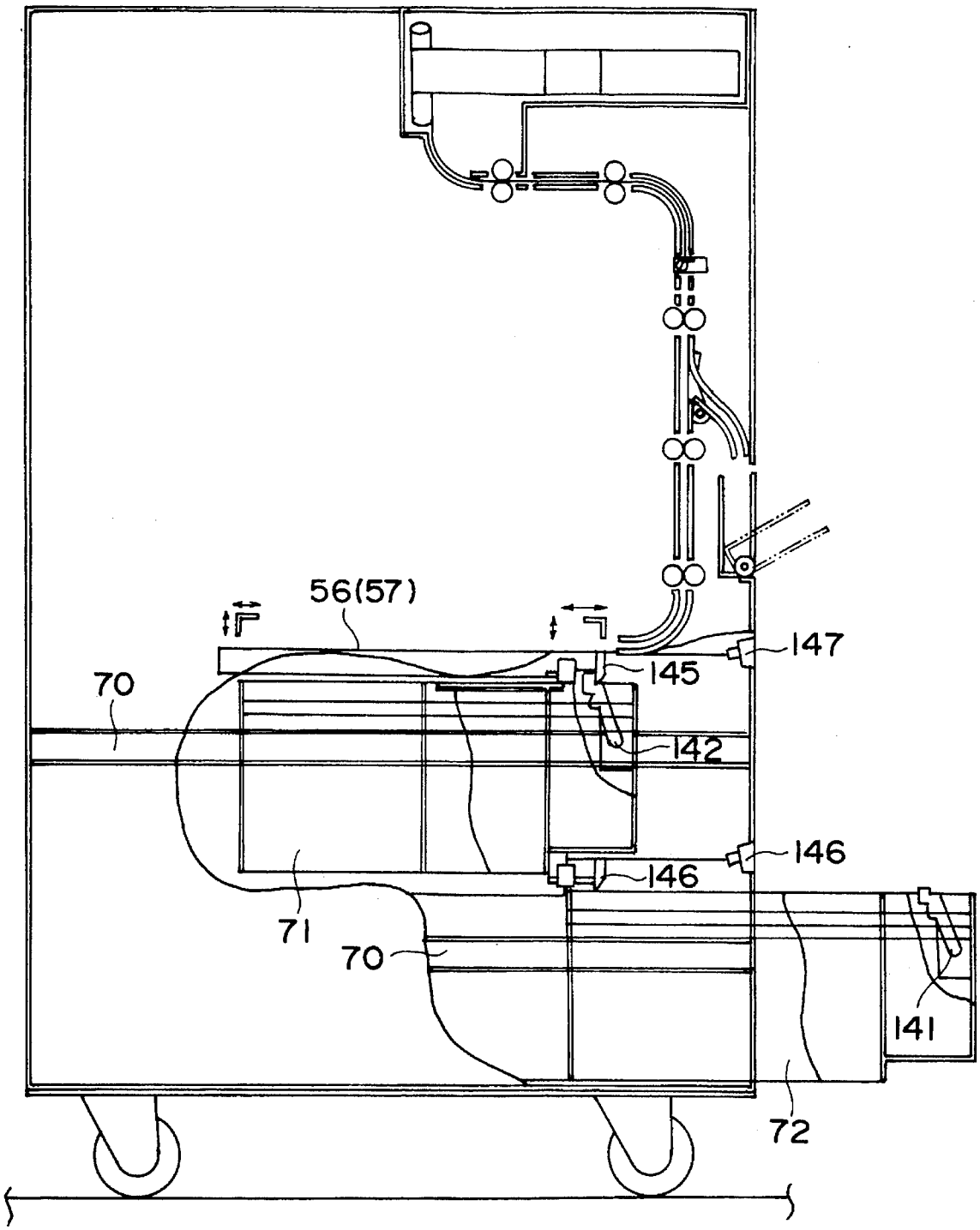
FIG. 31 is a sectional side view of a stacker portion.

On the other hand, when the bookbound sheet bundle on the carriage 60 is not contained in the stacker 71 or 72, as shown in FIG. 30, the bookbound sheet bundle is discharged out of the apparatus through the discharge opening 139. FIG. 31 is a side view of the stackers 71, 72. The stacker 72 has a gripper 141 which can be engaged by a lock device 143 of the apparatus. The reference numeral 146 denotes an indicator. Similarly, a gripper 142, a lock device 145 and an indicator 147 are associated with the stacker 71. Since two stackers are provided so that, while the bookbound sheet bundle is being conveyed to one of the stackers, the other stacker can be retracted or drawn, the check of the sample or the removal of the Fully stacked sheet bundles can be effected without stopping the bookbinding operation.

Figure 32:
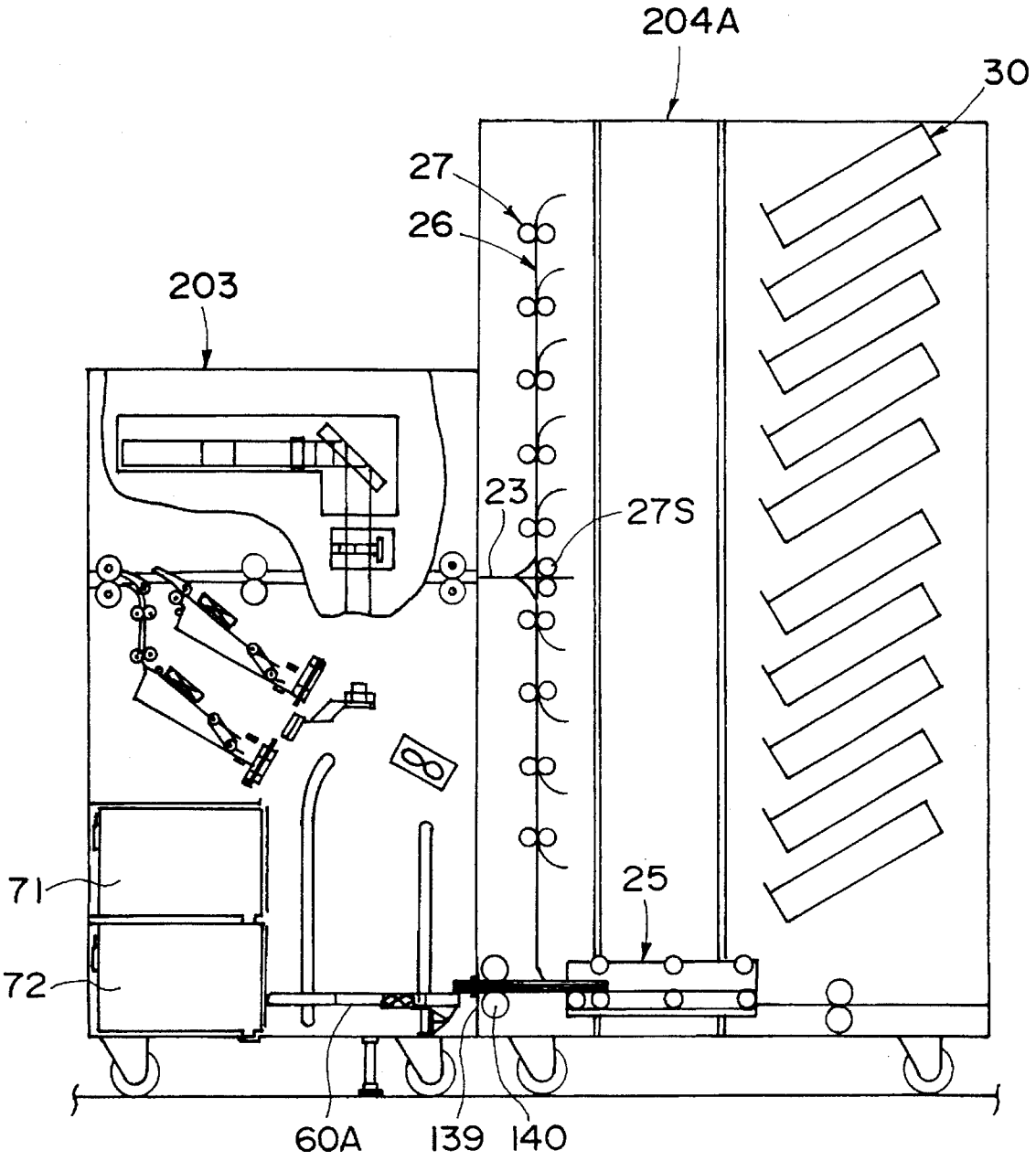
FIG. 32 is a sectional side view of a sheet sorting and containing apparatus according to another embodiment.

A sheet sorting and containing apparatus 204A shown in FIG. 32 serves to sort and contain the finished sheet bundles. The bookbound sheet bundle discharged from the bookbinding apparatus 203 is sent to the elevator 25 positioned at the lower portion of the sheet sorting and containing apparatus 204A. Then, by lifting or lowering the elevator 25, the bookbound sheet bundle is contained into a desired discharge tray 30. Incidentally, when it is not required to discharge the sheet bundle onto the discharge tray 30, the bookbound sheet bundle is discharged out of the sheet sorting and containing apparatus 204A through the elevator 25 positioned at the lowermost position.

In the above embodiments, since there are provided two sheet align trays for receiving and aligning the sheets on which the images were formed and two abutment members against which the sheets are abutted, while the sheets on one of the sheet align trays are being bookbound, the succeeding sheets can be introduced into the other sheet align tray, thereby improving the productivity of the on-line system including the book binding apparatus.

Incidentally, when three on more sheet align trays are used, the on-line system can cope with the image forming apparatus having the high image forming speed.

Further, since the abutment member has the means for previously heating the sheet bundle in the sheet align tray, it is not required for heating the sheet bundle from the room temperature during the heating bookbinding of the sheet bundle, thereby reducing the bookbinding time. Furthermore, since two tape heating apparatuses for heating the bind tape and for adhering the bind tape to the sheet bundle are provided, while the bind tape is being heated and adhered to the sheet bundle by one of the tape heating apparatus, the other tape heating apparatus can receive a new bind tape and pre-heat such a bind tape, thereby effecting the adhering and pre-heating of the bind tape efficiently.

What is claimed is:

1. A book binding apparatus comprising:

convey means for conveying a sheet on which an image is formed by image forming means;

a plurality of sheet supporting means for supporting a sheet bundle to align a tip end of each sheet with each other;

switching means for selecting one of said sheet supporting means to which the sheets conveyed by said convey means are sent;

move means for moving the sheet bundle supported by each of said sheet supporting means to move the aligned tip end thereof to a bind position; and bind means disposed at the bind position for adhering a bind tape to the aligned tip end of each sheet bundle moved by said move means, wherein said move means moves the sheet bundle so that the aligned tip end after movement is parallel to the aligned tip end before movement.

2. A book binding apparatus according to claim 1, wherein, when the sheet bundle supported by one of said sheet supporting means is moved by said move means and bound by said bind means, said switching means selects another of said sheet supporting means.

3. A book binding apparatus according to claim 1, wherein an align surface formed on said sheet supporting means and against which the sheets are abutted to be aligned is oriented in the same direction as a bind surface of said bind means against which the aligned tip end of the sheet bundle is abutted.

4. A book binding apparatus according to claim 1 or 3, wherein the bind position is arranged between said sheet supporting means, and said move means moves the aligned tip end of the sheet bundle from said sheet supporting means in a parallel condition.

5. A book binding apparatus according to claim 4, wherein said move means includes clamp means for pinching the aligned tip end of the sheet bundle and moving it to the bind position in the parallel condition.

6. A book binding apparatus according to claim 4, wherein said move means includes a drive means for shifting said sheet supporting means in a parallel condition so that the aligned tip end of the sheet bundle is moved to the bind position in the parallel condition by shifting said sheet supporting means in the parallel condition.

7. A book binding apparatus according to claim 1, wherein said sheet supporting means are provided with abutment members against which the tip ends of the sheets are abutted to be aligned.

8. A book binding apparatus according to claim 7, further comprising support means for supporting said abutment members for movement to approach to each other, and when said abutment members are approached to each other, the bind tape is bent and abutted against side surfaces of the sheet bundle abutted against said bind surface by side surfaces of said abutment members.

9. A book binding apparatus according to claim 1, wherein said sheet supporting means is provided with a tray inclined downwardly toward a downstream side thereof to support the sheet, and an abutment member is provided on a lower end of said tray so that the sheets are abutted against said abutment member by their own weights to be aligned.

10. A book binding apparatus according to claim 3, wherein said bind means includes heat means for melting and adhering heat-soluble adhesive between the bind tape and the aligned tip end of the sheet bundle.

11. A book binding apparatus according to claim 10, wherein said bind means includes a plurality of said heat means and shift means for shifting said heat means between the bind position and a waiting position, whereby said heat means are shifted between the bind position and the waiting position alternatively.

12. A book binding apparatus according to claim 11, wherein the bind tape from a bind tape supply means is supplied to said heat means at the waiting position.

13. A book binding apparatus according to claim 10, further comprising pre-heat means for heating the tip ends of the sheets aligned at an align means.

14. A book binding apparatus according to claim 1, wherein align means of said sheet supporting means includes a sweeping and collecting means for sweeping and collecting the sheets to an abutment member.

15. A book binding apparatus according to claim 1, wherein align means of said sheet supporting means includes air sending means for generating air flow directing toward a direction that the sheet is urged against a supporting surface of said sheet supporting means.

16. A book binding apparatus comprising:

convey means for conveying a sheet on which an image was formed by an image forming means;

a plurality of sheet supporting means for supporting a sheet;

switching means for selecting one of said sheet supporting means to which the sheets conveyed by said convey means are sent;

align means provided on each of said sheet supporting means for aligning ends of the sheets supported by said sheet supporting means as a sheet bundle;

bind means for binding an end of the sheet bundle aligned by said align means by using a bind tape and having a heat means for heating heat-soluble adhesive for adhering the bind tape to the end of the sheet bundle; and pre-heat means included in said align means for previously heating aligned end of the sheet bundle before the latter is bound.

17. A book binding apparatus according to claim 16, wherein, when the sheet bundle supported by one of said sheet supporting means is bound by said bind means, said switching means selects another of said sheet supporting means.

18. A book binding apparatus according to claim 16, wherein said sheet supporting means is provided with a tray inclined downwardly toward a downstream side thereof and adapted to support the sheet, and said align means comprises an abutment member provided on a lower end of said tray so that the sheets are abutted against said abutment member by their own weights to be aligned, and wherein said pre-heat means is provided on said abutment member.

19. A book binding apparatus according to claim 16, further comprising move means for moving the sheet bundle aligned by said align means from said sheet supporting means to said bind means.

20. A book binding apparatus according to claim 16, wherein a pair of said sheet supporting means are provided and a bind position where the sheet bundle is bound by said bind means is arranged between said pair of sheet supporting means, and further comprising support means for supporting said abutment members for movement to approach to each other, whereby, when said abutment members are approached to each other, the bind tape is urged against side surfaces of the sheet bundle transferred to said bind means by said move means by side surfaces of said abutment members.

21. A book binding apparatus according to claim 16, wherein a plurality of said heat means are provided, and further comprising shift means for shifting said heat means between a bind position and a waiting position alternatively, whereby the bind tape from a bind tape supply means is supplied to said heat means at said waiting position to previously heat the bind tape before the sheet bundle is bound by the bind tape.

22. A book binding apparatus comprising:

convey means for conveying a sheet on which an image was formed by an image forming means;

sheet supporting means for supporting sheets conveyed by said convey means to align a tip end of each sheet with each other;

bind means for binding at a bind position the aligned tip end of the sheet bundle by a bind tape and having a plurality of heat means to heat the bind tape for adhering it to the aligned tip end of the sheet bundle; and shifting means for shifting each of said heat means between the bind position and a waiting position, wherein one of said heat means previously heats the bind tape at the waiting position before the aligned tip end of the sheet bundle is bound by the bind tape.

23. A book binding apparatus according to claim 22, wherein the bind tape from bind tape supply means is supplied to the waiting position.

24. A book binding apparatus according to claim 22, wherein said shifting means has a pass-by path including pass-by passages.

25. A book binding apparatus according to claim 22, wherein a plurality of sheet supporting means are provided and, when the sheet bundle from one of said sheet supporting means is being bound, a new sheet on which an image was formed is sent to another of said sheet supporting means.

26. A book binding apparatus according to claim 25, further comprising move means for moving the aligned tip end of the sheet bundle supported by said sheet supporting means to said bind means.

27. An on-line system comprising:

an image forming apparatus for forming an image on a sheet;

said book binding apparatus according to one of claims 1, 16 and 22 for bookbinding the sheets on which the images were formed by said image forming apparatus; and a sorting and containing apparatus for sorting and containing bookbound sheet bundles discharged from said book binding apparatus;

wherein said book binding apparatus is arranged between said image forming apparatus and said sorting and containing apparatus.

28. An on-line system according to claim 27, wherein said book binding apparatus includes first switching means for selecting either a convey path for directly sending the sheet on which the image was formed by said image forming apparatus to said sorting and containing apparatus or a convey path for sending the sheet on which the image was formed on a bookbinding portion, thereby sending the sheet to said selected convey path.

29. An on-line system according to claim 28, further comprising second switching means for selecting either said sorting and containing apparatus or a stacking portion of said book binding apparatus to send the sheet bundle bookbound by said bookbinding portion to the selected one.

30. An on-line system according to claim 29, wherein said bookbinding portion includes a plurality of sheet supporting means for supporting the sheets sent through said first switching means; and bind means for binding a sheet bundle supported by said sheet supporting means by using a bind tape.

31. An on-line system according to claim 28, wherein said first switching means is a flapper for changing a conveying direction for the sheet.

32. An on-line system according to claim 29, wherein said second switching means includes convey means shiftable in a vertical direction and a handling means for shifting the sheet bundle bookbound by said bookbinding portion to said convey means, wherein the book bound sheet bundle is sent to said stacking portion or said sorting and containing portion by means of said handling means.

33. An on-line system according to claim 32, wherein a plurality of stacking portions are arranged side by side in a vertical direction, and when said convey means is stopped at need, the sheet bundle is sent from said convey means to one of said stacking portions by said handling means.

34. An on-line system according to claim 33, wherein said stacking portions can be retracted from said book binding apparatus, whereby, when the sheet bundle is being sent from said convey means to one of said stacking portions, the other stacking portions can be retracted.

* * * * *